US007107000B2

(12) United States Patent
Watanabe et al.

(10) Patent No.: US 7,107,000 B2
(45) Date of Patent: Sep. 12, 2006

(54) IMAGE HEATING APPARATUS HAVING FLEXIBLE SLEEVE

(75) Inventors: Kenji Watanabe, Shizuoka-ken (JP); Takayuki Miyamoto, Shizuoka-ken (JP); Katsuhiko Oba, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

(21) Appl. No.: 11/044,534

(22) Filed: Jan. 28, 2005

(65) Prior Publication Data

US 2005/0180788 A1 Aug. 18, 2005

(30) Foreign Application Priority Data

Jan. 30, 2004 (JP) ..... 2004-024342
Jan. 25, 2005 (JP) ..... 2005-016607

(51) Int. Cl.
*G03G 15/20* (2006.01)

(52) U.S. Cl. ..... 399/328; 399/330

(58) Field of Classification Search ..... 219/619; 399/328, 329, 330

See application file for complete search history.

(56) References Cited

U.S. PATENT DOCUMENTS

| | | | | |
|---|---|---|---|---|
| 4,970,219 | A | 11/1990 | Effland et al. | 514/339 |
| 4,983,615 | A | 1/1991 | Effland et al. | 514/337 |
| 5,034,403 | A | 7/1991 | Effland et al. | 514/338 |
| 5,083,168 | A | 1/1992 | Kusaka et al. | 355/285 |
| 5,149,941 | A | 9/1992 | Hirabayashi et al. | 219/216 |
| 5,162,634 | A | 11/1992 | Kusaka et al. | 219/216 |
| 5,210,579 | A | 5/1993 | Setoriyama et al. | 355/285 |
| 5,221,682 | A | 6/1993 | Effland et al. | 514/349 |
| 5,253,024 | A | 10/1993 | Okuda et al. | 355/282 |
| 5,262,834 | A | 11/1993 | Kusaka et al. | 355/285 |
| 5,293,202 | A | 3/1994 | Adachi et al. | 355/282 |
| 5,300,997 | A | 4/1994 | Hirabayashi et al. | 355/285 |
| 5,343,280 | A | 8/1994 | Hirabayashi et al. | 355/285 |
| 5,405,856 | A | 4/1995 | Effland et al. | 514/349 |
| 5,519,475 | A | 5/1996 | Miyamoto et al. | 355/271 |
| 5,525,775 | A | 6/1996 | Setoriyama et al. | 219/216 |
| 5,568,240 | A | 10/1996 | Ohtsuka | 355/285 |
| 5,722,026 | A | 2/1998 | Goto et al. | 399/333 |
| 5,752,149 | A | 5/1998 | Yuza et al. | 399/329 |
| 5,767,484 | A | 6/1998 | Hirabayashi et al. | 219/216 |
| 5,778,293 | A * | 7/1998 | Ohtsuka | 399/329 |

(Continued)

FOREIGN PATENT DOCUMENTS

| | | |
|---|---|---|
| JP | 63-313182 | 12/1988 |

(Continued)

*Primary Examiner*—Hoang Ngo
(74) *Attorney, Agent, or Firm*—Fitzpatrick, Cella, Harper & Scinto

(57) ABSTRACT

The image heating apparatus for heating an image formed on a recording material, comprises a flexible sleeve; a driving roller which contacts an outer peripheral surface of said sleeve and rotates said sleeve; a sliding member which contacts an inner peripheral surface of said sleeve and forms said driving roller together with a nip portion by nipping said sleeve between thereof; and an inner surface regulating member comprising an opposing area opposed to the inner peripheral surface of a generatrix direction end portion of said sleeve; wherein the recording material is nipped and conveyed by the nip portion; and wherein a outlineoutline of the opposing area of said inner surface regulating member is approximately similar to the outlineoutline of the end face of said sleeve when said sleeve is rotated by said driving roller in a state in which said inner surface regulating member is not attached to said apparatus. In this way, the durability of the flexible sleeve can be enhanced.

24 Claims, 16 Drawing Sheets

U.S. PATENT DOCUMENTS

| | | | | |
|---|---|---|---|---|
| 5,860,051 | A | 1/1999 | Goto et al. | 399/529 |
| 5,920,757 | A | 7/1999 | Izawa et al. | 399/329 |
| 5,970,299 | A * | 10/1999 | Sano et al. | 399/330 |
| 6,085,058 | A | 7/2000 | Goto et al. | 399/313 |
| 6,115,563 | A | 9/2000 | Miyamoto | 399/67 |
| 6,185,383 | B1 | 2/2001 | Kanari et al. | 399/45 |
| 6,298,213 | B1 | 10/2001 | Miyamoto et al. | 399/320 |
| 6,336,009 | B1 | 1/2002 | Suzumi et al. | 399/67 |
| 6,493,521 | B1 | 12/2002 | Miyamoto et al. | 399/44 |
| 6,701,102 | B1 | 3/2004 | Hasegawa et al. | 399/69 |
| 6,763,205 | B1 | 7/2004 | Izawa et al. | 399/69 |
| RE38,810 | E * | 10/2005 | Terada et al. | 399/328 |
| 2003/0206756 | A1 | 11/2003 | Kanamori et al. | 399/328 |
| 2004/0253027 | A1 | 12/2004 | Kato et al. | 399/328 |

FOREIGN PATENT DOCUMENTS

| | | |
|---|---|---|
| JP | 2-157878 | 6/1990 |
| JP | 3124375 | 5/1991 |
| JP | 4-44075 | 2/1992 |
| JP | 4-204980 | 7/1992 |
| JP | 7-114276 | 5/1995 |
| JP | 2001-183930 | 7/2001 |
| JP | 2003-316180 | 11/2003 |
| JP | 2004-29658 | 1/2004 |

* cited by examiner

IMAGE HEATING APPARATUS HAVING FLEXIBLE SLEEVE

BACKGROUND OF THE INVENTION

1. Field of the Invention

The present invention relates to an image heating apparatus suitable if used as a fixing apparatus mounted on a copying machine or a printer, and in particular, it relates to an image heating apparatus using a flexible sleeve.

2. Related Background Art

A description will be made with a fixing apparatus in an image forming apparatus such as an electrophotographic copying machine and a printer as an example. In general, in the image forming apparatus, as the fixing apparatus (a fixer), which heats and fixes an unfixed toner image on a recording material surface as a permanent fixed image indirectly (transferred) or directly formed and borne on a recording material (paper) by an adequate image forming process means such as the electrophotographic process, a heating apparatus of a heat roller system has been conventionally in wide use.

In recent years, an apparatus of a film heating system has been put into practical use in view of a quick start and energy saving. Further, the heating apparatus of an electromagnetic induction heating system, which allows a film composed of a metal to heat itself, has been proposed.

a) Fixing Apparatus of Film Heating System

The fixing apparatus of the film heating system, for example, has been proposed in Japanese Patent Application Laid-Open Nos. S63-313182, H02-157878, H04-44075, H04-204980, and the like. That is, a pressure welding nip portion (hereinafter referred to as fixing nip portion) is formed by nipping a heat resisting film (hereinafter referred to as fixing film) between a ceramic heater as a heating body and a pressure roller as a pressure member, and a recording material forming and bearing an unfixed toner image is introduced between the fixing film of the fixing nip portion and the pressure roller, and is nipped and conveyed together with the fixing film, so that the unfixed toner image is fixed on the surface of the recording material by an applied pressure of the fixing nip portion, while giving a heat of the ceramic heater through the fixing film.

This fixing apparatus of the film heating system can constitute an on-demand type apparatus by using a member of low heat capacity for the ceramic heater and the film, and may generate heat of a predetermined fixing temperature by turning on the ceramic heater of a heat source only when an image formation is performed, and has advantages in that a waiting time from turning on the power source of the image forming apparatus until reaching an image formation executable state is short (quick startability), and a power consumption during a standby time period is sharply reduced (power saving) and the like.

Further, in the publications of among the above described Japanese Patent applications, those described in Japanese Patent Application Laid-Open Nos. H04-44075 and H04-204980, the film (flexible sleeve) by driving the pressure roller (pressure roller driving type), and comparing to the type which allows the flexible sleeve to rotate by providing a driving roller and a tension roller in the interior of the flexible sleeve, have an advantage of being simple in the structure.

b) Fixing Device of Electromagnetic Induction Heating System

For example, in the Japanese Patent Application Laid-Open No. H07-114276, there has been disclosed an induction heat fixing device, in which an eddy current is induced in a metallic layer (heat generating layer) of a fixing film by magnetic flux, and heat is generated by its joule heat. This device can make the fixing film to directly generate heat by utilizing the generation of the induced current, and achieves a fixing process of higher efficiency than the fixing device of the heat roller system which has a halogen lamp as its heat source.

In FIG. 14 is shown a schematic structure of an example of the fixing apparatus of the electromagnetic induction heating system which has improved its efficiency by concentrating the alternating magnetic flux of an excitation coil into a fixing nip portion. This fixing apparatus comprises a fixing film (flexible sleeve) 10 having a metallic layer, a film guide member 16C disposed in the inner face of this film, a magnetic field generating means 15 having an excitation coil 18 and a magnetic core 17, and a pressure roller 30 allowing the film 10 to rotate. In this example, a nip portion N conveying a recording paper P is formed by the film guide member 16C and the pressure roller 30. When the excitation coil 18 is energized, an eddy current is generated in the metallic layer of the fixing film 10, and the fixing film generates heat. By this heat, a toner image t on the recording paper P is heated and fixed.

As described above, both of the fixing device of the system which heats the toner image by a heater through the flexible sleeve and the fixing device of the system which heats the toner image by heating the flexible sleeve itself use the flexible sleeve.

In such a fixing device using the flexible sleeve, particularly in the device using a flexible sleeve made of a metal, it is necessary to take into consideration a breakage of sleeve due to metal fatigue. Further, from among the devices using the above described flexible sleeve, the device of a pressure roller drive type is simple in structure, and moreover, a load given to the flexible sleeve can be made small. However, particularly in case the flexible sleeve made of a metal is used, even if it is the device of the pressure roller drive type, it is necessary to take into consideration a breakage of sleeve due to metal fatigue. For example, when the sleeve 10 is driven by the pressure roller 30, the sleeve 10 approaches one side in a generatrix direction, and in case its approaching force is strong, a buckling stress is generated in the end portion in the generatrix direction, thereby accelerating a fatigue phenomenon. Alternatively, since a large frictional force acts on the end portion by its approaching force, the sleeve 10 is unable to aptly slide on the surface against which the sleeve 10 abuts, and the sleeve 10 is locally over deformed, thereby accelerating the fatigue phenomenon.

Thus, the flexible sleeve made of a metal is prone to break, comparing to the flexible sleeve made of resin such as polyamide, and consequently, various designs have been made to consider and control the metal fatigue of the flexible sleeve.

Incidentally, the present inventors have found a new cause which invites the metal fatigue of the flexible sleeve.

This cause is such that, when the sleeve 10 is driven by the pressure roller 30, though the sleeve is deformed into a shape as natural as it desires, it is forced to be partially reformed into another shape, and as a result, the stress partially acting on the sleeve becomes large, so that the fatigue phenomenon is accelerated.

SUMMARY OF THE INVENTION

The present invention has been made in view of the above described problems, and the purpose of the invention is to provide an image forming apparatus, which can enhance durability of a flexible sleeve.

Another purpose of the invention is to provide an image forming apparatus, which can reduce a stress acting on the flexible sleeve.

A further purpose of the invention is to provide an image forming apparatus including a flexible sleeve, a driving roller which contacts an outer peripheral surface of said sleeve and rotates said sleeve, a sliding member which contacts an inner peripheral surface of said sleeve and forms a nip portion together with said driving roller by nipping said sleeve between thereof; and an inner surface regulating member including an opposing area opposed to the inner peripheral surface of an end portion in a generatrix direction of said sleeve, wherein the recording material is nipped and conveyed by the nip portion, and wherein an outline of the opposing area of said inner surface regulating member is approximately similar to an outline of an end face of said sleeve when said sleeve is rotated by said driving roller in a state in which said inner surface regulating member is not attached to said apparatus.

Still further purpose of the present invention is to provide an image forming apparatus including a flexible sleeve, a driving roller which contacts an outer peripheral surface of said sleeve and rotates said sleeve, a sliding member which contacts an inner peripheral surface of said sleeve and forms a nip portion together with said driving roller by nipping said sleeve between thereof, and an inner surface regulating member including an opposing area opposed to the inner peripheral surface of an end portion in a generatrix direction of said sleeve, wherein the recording material is nipped and conveyed by the nip portion, and wherein an outline of the opposing area of said inner surface regulating member is approximately similar to a rotational locus of said sleeve formed on a planar measuring plate when said sleeve is rotated by said driving roller in a state in which said inner surface regulating member is not attached to said apparatus, and moreover, an end face of said sleeve is contacted to the planar measuring plate.

Further object of the present invention will become apparent by reading the following detailed description with reference to the accompanying drawings.

DETAILED DESCRIPTION OF THE PREFERRED EMBODIMENTS (First Embodiment)

(1) Fixing Apparatus (Image Heating Apparatus) 100

(A) General Structure of the Apparatus

Figure 1:
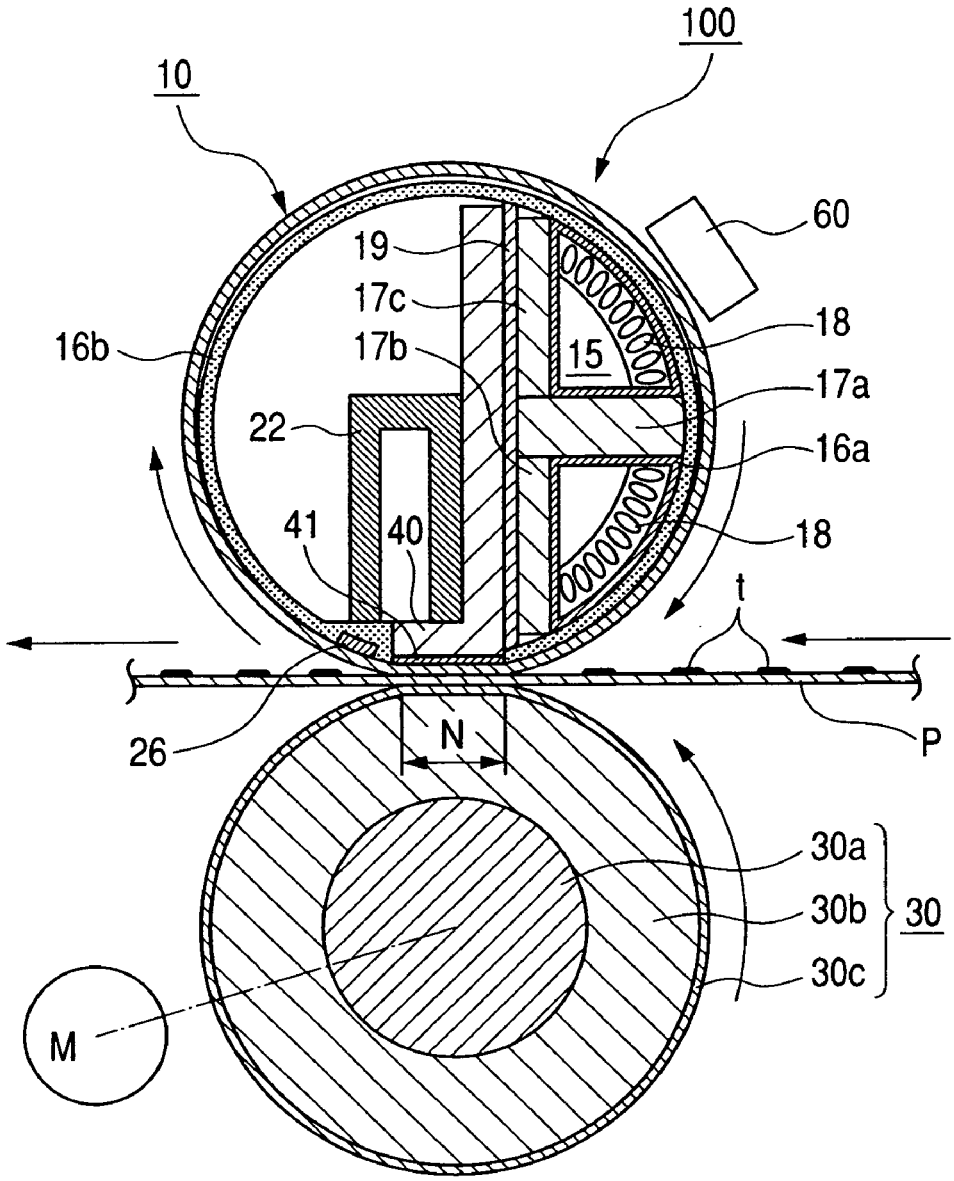
FIG. 1 is a sectional view showing major components of an image heating apparatus (fixing apparatus) of a first embodiment.
Figure 2:
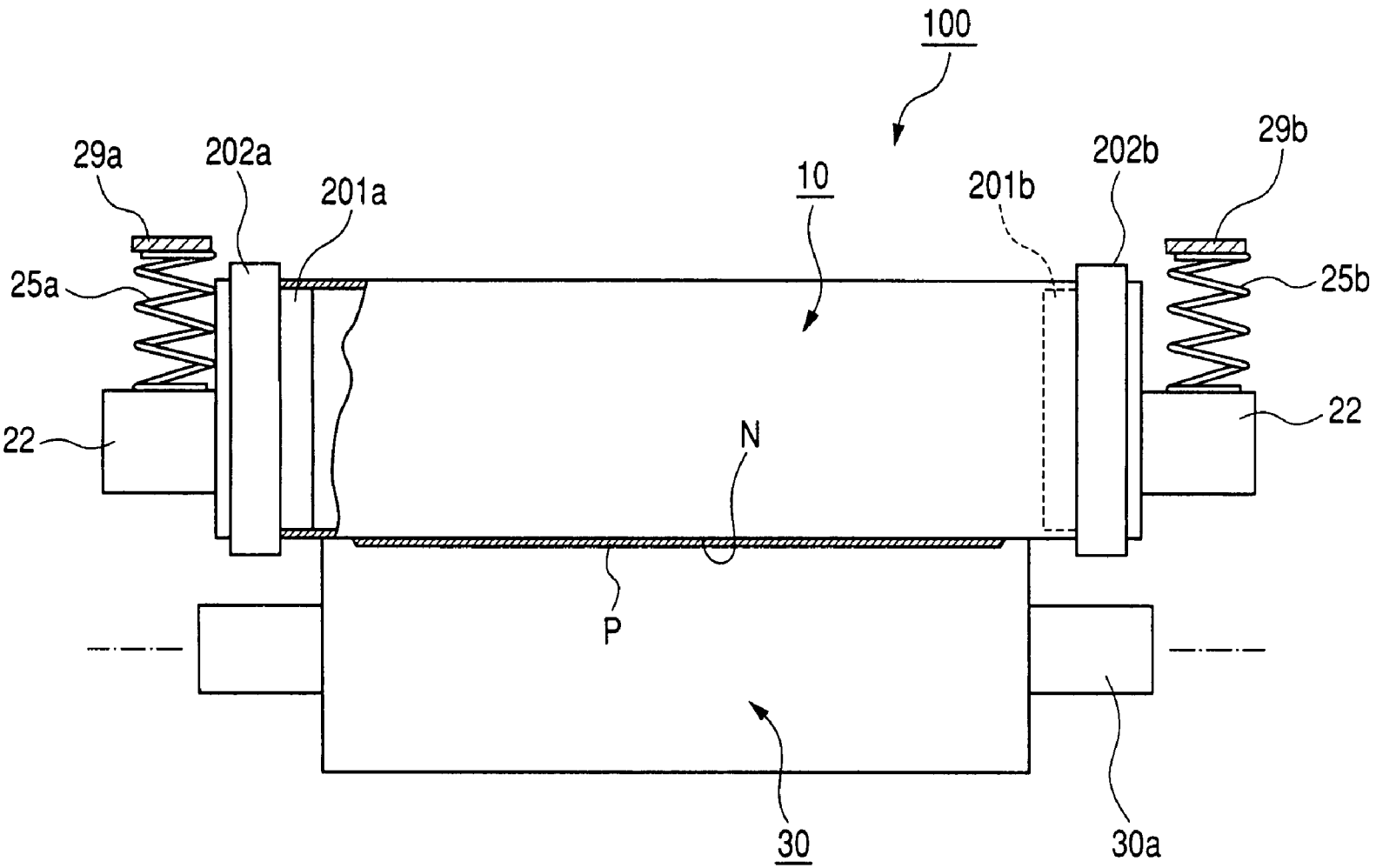
FIG. 2 is a front view showing major components of the image heating apparatus of the first embodiment.

In the present embodiment, the fixing apparatus is an apparatus of an electromagnetic induction heating system. FIG.1 is a transverse sectional model view of major components of the fixing apparatus 100 of the present embodiment, and FIG. 2 is a front model view of the major components of FIG. 2.

Figure 14:
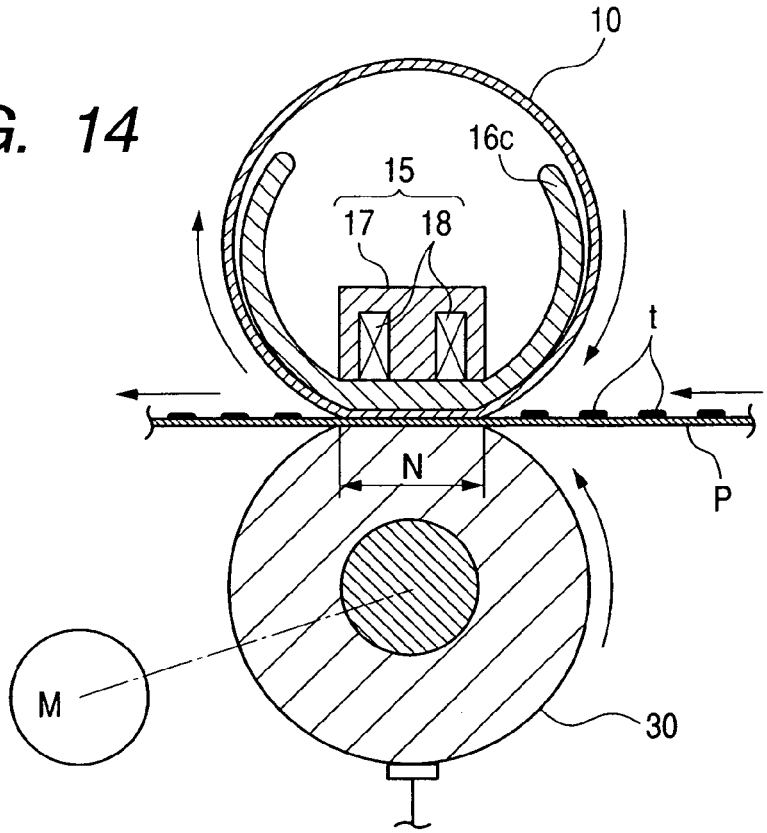
FIG. 14 is a sectional view of a conventional fixing apparatus.

The apparatus 100 of the present embodiment is an electromagnetic induction heating fixing apparatus of a pressure roller driving system, which uses an electromagnetic induction heating sleeve in the shape of a film and cylinder as a fixing sleeve (flexible sleeve) and rotates the fixing sleeve by driving a pressure roller (driving roller) by a motor. The same reference numerals will be attached to the component members and portions common with the apparatuses of FIGS. 12 and 14, and repeated description thereof will be omitted.

Magnetic filed generating means 15 comprises magnetic cores 17*a*, 17*b*, 17*c* and an excitation coil 18. The magnetic cores 17*a*, 17*b* and 17*c* are members of high magnetic permeability, and materials used for cores of the transformer such as ferrite and permalloy are preferable, and a ferrite having few loss even in the case of 100 kHz or more is more preferably used.

An excitation circuit 27 is connected to power supply portions 18*a* and 18*b* (FIG. 3) of the excitation coil 18. This excitation circuit 27 is allowed to generate a high frequency of 20 kHz to 500 kHz by a switching power source.

The excitation coil 18 generates an alternating magnetic flux by an alternating current (high frequency current) supplied from the excitation circuit 27.

Reference numerals 16*a* and 16*b* denote a sleeve guide member which is an approximately semi-circular arc tubbish type in transverse section, and constitutes an approximate cylindrical body by allowing opening sides mutually to face to face, and as a cylindrical body of rotation in the outside, an electromagnetic induction heating sleeve 10 having a total length LF=283 mm and an outer diameter of 34 mm is loosely engaged externally with a cylindrical sleeve guide member 16 with an adequate clearance provided between thereof.

The sleeve guide member 16*a* holds the magnetic cores 17*a*, 17*b*, 17*c* and the excitation coil 18 as magnetic field generating means 15 in its interior.

Further, the sleeve guide member portion 16*a* is attached with a good heat conductive member (sliding member) 40 which contacts the inner peripheral surface of the sleeve 10, and with the sleeve 10 nipped in-between, the good heat conductive member 40 and the pressure roller 30 forms a fixing nip portion N.

In the present embodiment, aluminum having a thickness of 1 mm is used for the good heat conductive member 40.

Further, the good heat conductive member 40 is disposed outside of a magnetic field so as not to be affected by the magnetic field generated from the excitation coil 18 and the magnetic cores 17*a*, 17*b* and 17*c* which are the magnetic field generating means 15.

To be specific, the magnetic cores 17*b* and 17*c* are disposed at positions spaced apart from the excitation coil 18, and moreover, the good heat conductive member 40 is disposed at the side opposed to the excitation coil 18 with the magnetic cores 17*b* and 17*c* as a boundary, so that the good heat conductive member 40 is positioned outside of a magnetic path by the excitation coil 18, thereby preventing the good heat conductive member 40 from being affected by the magnetic field.

Reference numeral 22 denotes a horizontal pressure rigid stay disposed by being abutted against the rear face side of a portion corresponding to the nip portion N of the good heat conductive member 40 and the inner flat face portion of the sleeve guide member 16*b*.

Reference numeral 19 denotes an insulating member which insulates between the magnetic cores 17*a*, 17*b* and 17*c* as well as the excitation coil 18 and the pressure rigid stay 22.

At positions corresponding to both end sides further than the sleeve guide member 16*a*, that is, at positions corresponding to both end portions in a generatrix direction of the sleeve 10, there are provided inner peripheral surface regulating members 201*a* and 201*b*, respectively, each of which is fixed to sleeve end portion regulating members 202*a* and 202*b* provided further outside, respectively. In the present embodiment, though the inner peripheral surface regulating member 201 and the end portion regulating member 202 are separate parts, they may be integrally molded. The sleeve end portion regulating members 202*a* and 202*b* are opposed to the end face of the sleeve 10, and regulates the movement of the sleeve 10 in case the sleeve 10 moves in a longitudinal direction (generatrix direction), thereby attempting to keep the sleeve at a predetermined position in the longitudinal direction. The inner peripheral surface regulating members 201*a* and 201*b* will be described in detail at the following item (D).

The pressure roller 30 as a driving roller is constituted by a cored bar 30*a*, a heat resisting elastic material layer 30*b* such as silicone rubber, fluorine-contained rubber and fluorine-contained resin, which is concentrically integrally molded and coated around the cored bar in the shape of a roller, and a fluorine-contained resin layer (a thickness of approximate 10 μm to 100 μm) such as PFA, PTFE and FEP as a releasing layer 30*c* of a surface layer, and both end portions of the cored bar 30*a* are rotatably bearing-held and disposed between unillustrated chassis side plates of the apparatus. In the present embodiment, the pressure roller 30 with a pressure face length LR=250 mm and an outer diameter 20 mm is used. Consequently, a total length LF of the sleeve 10 is larger than the abutting face length LR of the pressure roller 30. Further, the positional relationship between the sleeve 10 and the pressure roller 30 in the longitudinal direction (generatrix direction) is a positional relationship in which both end portions have a distance existing between the end portion of the sleeve and the end portion of the pressure roller as shown in FIG. 2. Consequently, the length in the longitudinal direction of the nip portion N is approximately equal to the length in the longitudinal direction of the elastic layer of the pressure roller.

Between both the end portions of the pressure rigid stay 22 and spring bearing members 29*a* and 29*b* of the chassis side of the apparatus, there are provided pressure springs 25*a* and 25*b*, respectively, so that a pressing down force is acted on the pressure rigid stay 22. In this way, the lower face of a portion corresponding to the nip portion N of the good heat conductive member 40 and the upper face of the pressure roller 30 are pressure-contacted with the fixing sleeve 10 nipped between thereof, thereby forming a fixing-nip portion N of a predetermined width.

In the present embodiment, a pressing force (linear pressure) by the pressure roller 30 at the nip portion N is taken approximately as 7.8 N/cm (800 g/cm).

Here, to secure the width of the nip N to some extent, if the hardness of the pressure roller 30 is too high, it is not preferable. The hardness of the pressure roller 30 is desirable to be in the range of an upper limit 75 degree to secure the nip, and an approximate lower limit 45 degree (when Asker C hardness measured value from above the surface layer of the pressure roller is 9.8 N (1 kg weighting)) in view of the mechanical strength.

In the present embodiment, the hardness of the pressure roller 30 is taken approximately as 56 degree, and a nip amount N (width in a conveying direction of the recording paper) is taken approximately as 7 mm.

The pressure roller 30 is rotated and driven in a counter-clock wise shown by an arrow mark by driving means M. By this rotational driving of the pressure roller 30, a frictional force with the outer face of the pressure roller 30 allows a rotational force to act on the sleeve 10, and the sleeve 10, while its inner face adheres to the lower face of the good heat conductive member 40 at the fixing nip N and slides, rotates around the outer periphery of the sleeve guide members 16*a* and 16*b* with a peripheral velocity approximately corresponding to a peripheral velocity of the pressure roller 30 in a clock wise direction shown by the arrow mark. However, an outer peripheral face area of the sleeve guide member which is contacted by the inner peripheral face of the sleeve 10 at the rotating time of the sleeve 10 is spaced approximately several millimeters apart from an upper stream side end portion of the nip portion N in the sleeve rotational direction, and hardly contacts the down stream side further than a down stream side end portion of the nip portion N in the sleeve rotational direction. That is, the inner face of the sleeve 10 hardly contacts the outer peripheral faces of the sleeve guide members 16*a* and 16*b* even when the sleeve 10 rotates, but only contacts a sliding member 40 (to be exact, a lubricating layer 41 to be described later) at the nip portion N. The sleeve guide members 16*a* and 16*b* of the present embodiment have a function only to reduce a deformed amount of the sleeve in case a sudden deformation occurs while the sleeve 10 rotates.

Further, to reduce a mutual sliding frictional force between the lower face of the good heat conductive member 40 in the fixing nip portion N and the inner face of the sleeve 10, between the lower face of the good heat conductive member 40 of the fixing nip portion N and the inner face of the sleeve 10 is interposed a lubricant such as a heat resisting grease or the lower face of the good heat conductive member 40 is covered by the lubricating layer 41, so that slidability of the sleeve 10 at the nip N can be also improved. This is to prevent the sliding sleeve 10 from being damaged and to prevent the durability of the sleeve 10 from being deteriorated in case a face slidability is not preferable material-wise or the finishing work is simplified similarly to the case where aluminum is used as the good heat conductive member 40.

The good heat conductive member 40 is effective to uniform temperature distribution in a longitudinal direction of the sleeve 10, and for example, in case a small size paper is fed as a recording material P, the heat of a non-paper feeding portion of the sleeve 10 is conducted to the good conductive member 40, and by the heat conduction in a longitudinal direction in the good heat conductive member 40, the heat of the non paper feeding portion is conducted to a small size paper feeding portion. In this way, the effect of reducing the power consumption at the small size paper feeding time can be obtained.

Figure 3:
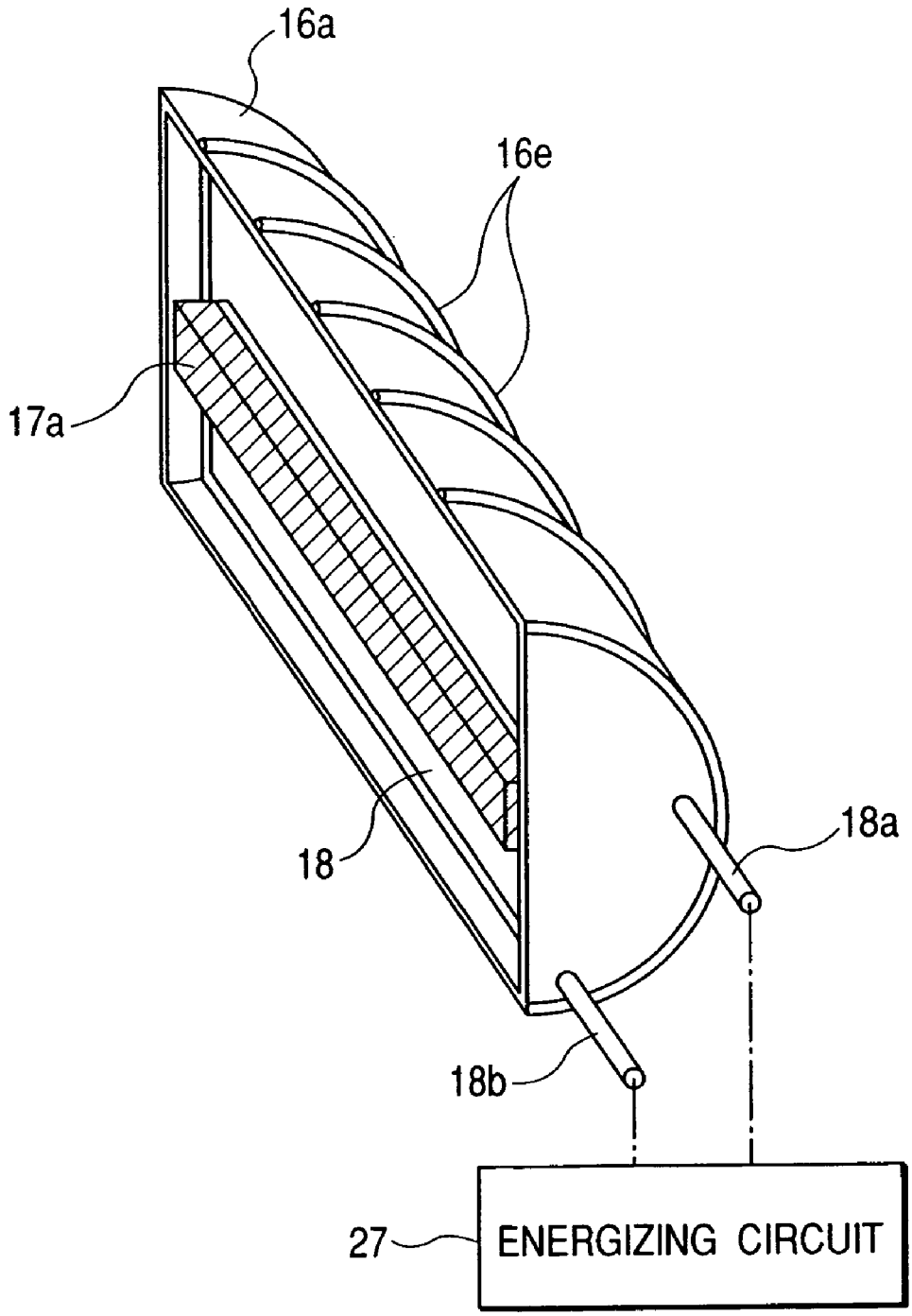
FIG. 3 is an oblique view of a magnetic field generating means portion.

Further, as shown in FIG. 3, on the outer peripheral face of the sleeve guide member 16*a*, a convex rib portion 16*e* is formed and provided along its longitudinal direction spaced apart at predetermined intervals, and even if by any chance the sleeve 10 contacts the sleeve guide member 16, a frictional sliding resistance between the sleeve guide member 16 and the inner face of the sleeve 10 is reduced so as to make a rotating load of the sleeve 10 small. Such convex rib portion 16*e* can be also similarly formed and provided for the sleeve guide member 16*b*.

At this time, the convex rib portion 16*e* is a portion which strictly guides the sleeve 10 only if anything should happen, and is not constructed to be positively slid together with the sleeve 10 so as to perform a positional control. Since the positional control and shape control of the sleeve 10 are main parts of the present invention, it will be described later in the item D) Inner peripheral surface regulating member 201 (a and b).

Figure 4:
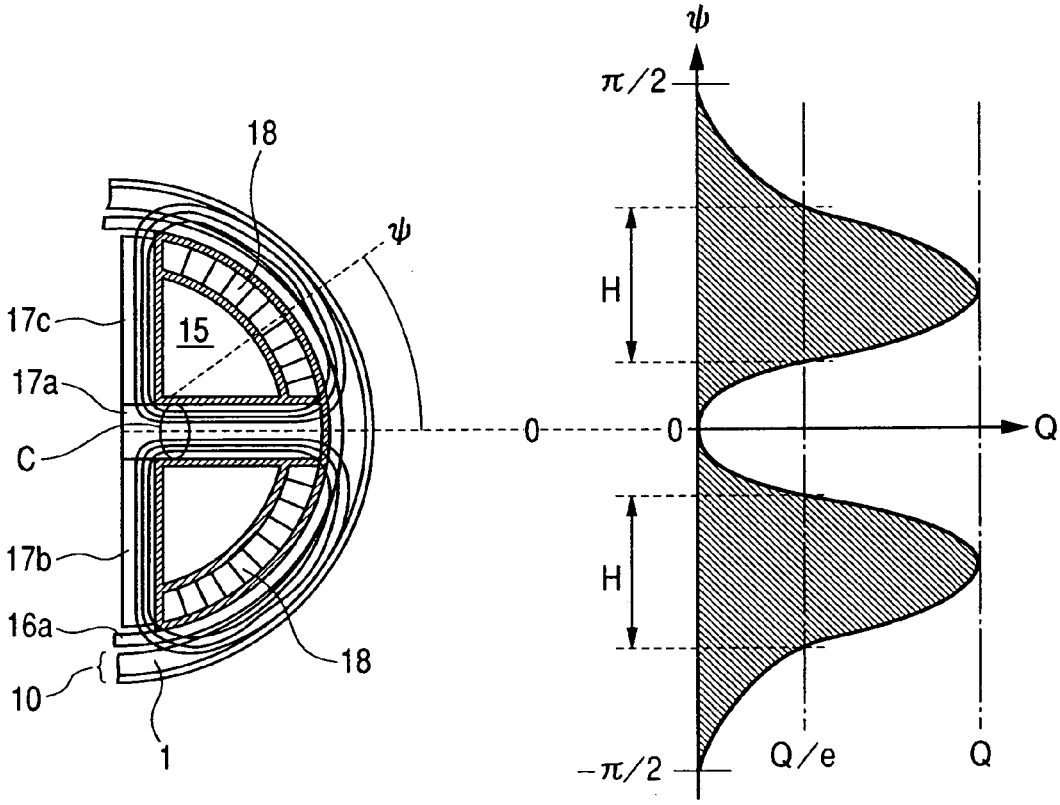
FIG. 4 is a schematic illustration showing a state of generating an alternating magnetic flux.

FIG. 4 schematically shows a generating state of an alternating magnetic flux. A magnetic flux C shows a part of the generated alternating magnetic flux.

The alternating magnetic flux C guided by the magnetic cores 17*a*, 17*b* and 17*c* generates an eddy current in the electromagnetic induction heat dissipating layer 1 of the sleeve 10 between the magnetic core 17*a* and the magnetic core 17*b* and between the magnetic core 17*a* and the magnetic core 17*c*. This eddy current generates a joule heat (eddy current loss) in the electromagnetic induction heat dissipating layer 1 by intrinsic resistance of the electromagnetic induction heat dissipating layer 1.

A heat dissipating amount Q here is decided by a density of magnetic flux which passes through the electromagnetic induction heat dissipating layer 1, and shows a distribution as shown in the graph of FIG. 4. The graph of FIG. 4 shows a position in a circumferential direction in the sleeve 10 shown by an angle Φ wherein the axis of ordinates takes a center of the magnetic core 17*a* as a 0, and the axis of abscissas shows the heat dissipating amount Q at the electronomagnetic induction heat dissipating layer 1 of the sleeve 10. Here, in case the heat dissipating area H takes the maximum heat dissipating amount as Q, it is defined as an area in which the heat dissipating amount is more than Q/e. This is an area in which a heat dissipating amount necessary for fixing can be obtained.

The temperature of this fixing nip portion N is controlled in such a way that a predetermined temperature is maintained by controlling the current supply for the excitation coil 18 by a temperature control system including temperature detecting means 26 (FIG. 1).

The temperature detecting means 26 is a temperature sensor such as a thermistor for detecting the temperature of the sleeve 10, and in the present embodiment, based on temperature information of the sleeve 10 measured by this temperature sensor 26, the temperature of the fixing nip portion N is allowed to be controlled.

In a state where the sleeve 10 rotates, and by the electrical power supplying to the excitation coil 18 from the excitation circuit 27, the electromagnetic induction heat dissipation of the sleeve 10 is performed as described above, and the fixing nip portion N rises to a predetermined temperature so as to be controlled in the temperature, the recording material P formed with an unfixing toner image t conveyed from an image forming means portion has its imaged face turned upward between the sleeve 10 of the fixing nip portion N and the pressure roller 30, that is, the unfixing image t is introduced opposing to a sleeve face, and the imaged face adheres to the outer face of the sleeve 10 at the fixing nip portion N, and nips and conveys the fixing nip portion N together with the sleeve 10.

In the course of the fixing nip portion N being nipped and conveyed by the recording material P together with the sleeve 10, the unfixing toner image t on the recording material p is heated and fixed by the electromagnetic induction heat dissipation of the sleeve 10.

When the recording material P passes through the fixing nip portion N, it is separated from the outer face of the sleeve 10, and is discharged and conveyed.

After the toner image fixed on the recording material P passes through the fixing nip portion, it is cooled and becomes a permanent fixed image.

In the present embodiment, as shown in FIG. 1, a thermo switch 60 is disposed at a position opposing to the heat dissipating area of the sleeve 10, which is a thermal element for shutting off the power supply to the excitation coil 18 when a temperature control being impossible.

B) Excitation Coil 18

The excitation coil 18 uses a bundle of fine-wires made of copper with each wire insulation-coated as a conducting wire (electric wire) which constitutes a coil, and winds this wire plural times in a longitudinal direction around the core 17*a*, thereby forming the excitation coil. In the present embodiment, ten turns of wire winding makes the excitation coil 18.

For the insulating coating, it is preferable to use a coating having a heat resistance in consideration of the heat conduction by the heat dissipation of the sleeve 10. For example, a coating such as amide-imide and polyimide is preferably used.

The excitation coil 18 may improve its density by applying a pressure from the outside.

The shape of the excitation coil 18 is formed along a curved face of the heat dissipating layer 1 of the sleeve 10 as shown in FIGS. 1 and 4. In the present embodiment, the distance between the heat dissipating layer 1 of the sleeve 10 and the excitation coil 18 is set so as to be approximately 2 mm.

As the material of the sleeve guide members (excitation coil holding members) 16*a* and 16*b*, those being excellent in insulating properties and heat resistance are preferable. For example, phenol resin, fluorine resin, polyimide resin, polyamide resin, polyamideimide resin, PEEK resin, PES resin, PPS resin, PFA resin, PTFE resin, FEP resin, LCP resin, and the like are preferably selected.

Although it is preferable that the distance between the magnetic cores 17*a*, 17*b* and 17*c* as well as the excitation coil 18 and the heat dissipating layer 1 of the sleeve 10 is drawn as closer as possible so that absorption effect of the magnetic flux is increased, and if this distance exceeds more than 5 mm, this effect is remarkably decreased, and therefore, the distance is preferably set within 5 mm. Further, if it is within 5 mm, the distance between the heat dissipating layer 1 of the sleeve 10 and the excitation coil 18 is not required to be constant.

C) Sleeve (Flexible Sleeve) 10

Figure 5A:
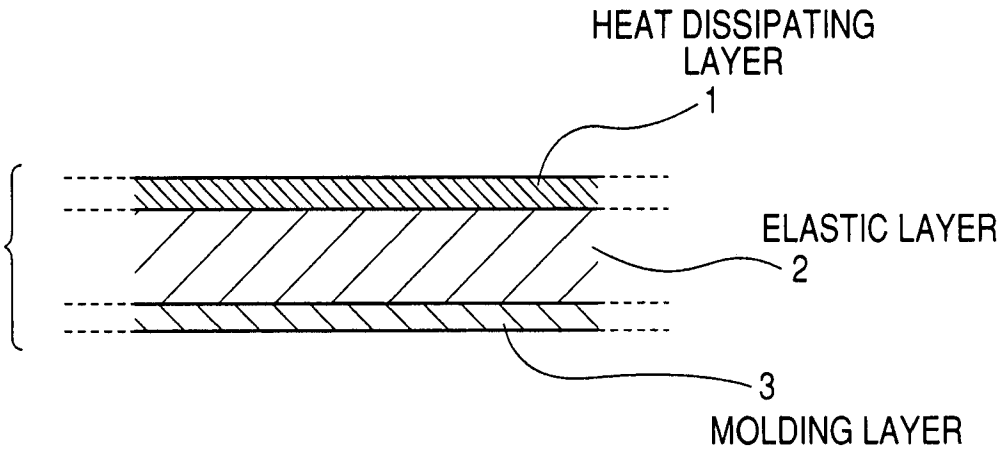
FIGS. 5A and 5B are schematic illustrations showing a layer structure of a sleeve.
Figure 5B:
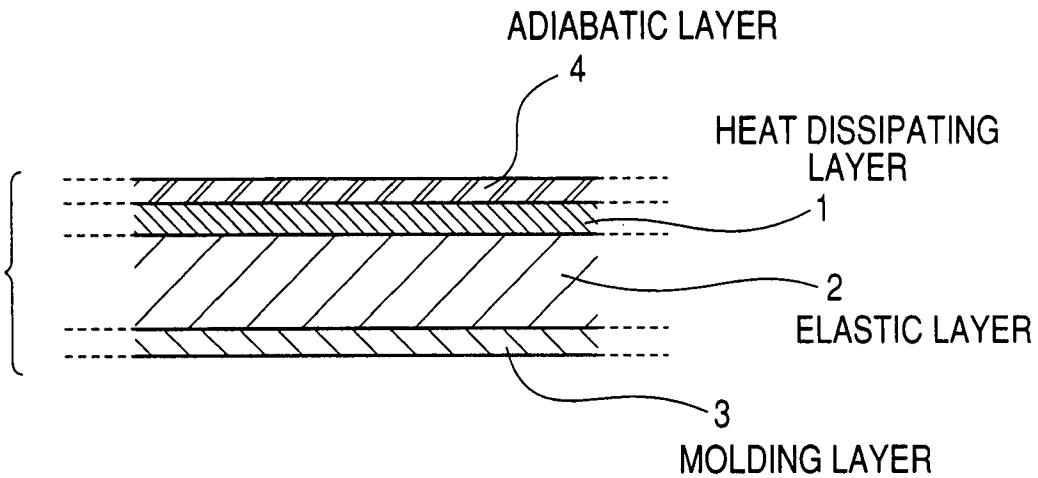

FIGS. 5A and 5B are model views of a layer structure of the interior of the sleeve 10 (fixing film) in the present embodiment. The upper sides of FIGS. 5A and 5B are the inner face sides (sleeve guide sides), and the lower sides show the outer face sides (pressure roller sides).

The sleeve 10 of the present embodiment in FIG. 5A is of a composite structure of the heat dissipating layer 1 composed of a metal sleeve and the like, which is a basic layer of the electromagnetic induction heat dissipating sleeve 10, an elastic layer 2 laminated on its outer face, and a demolding layer(releasing layer) 3 laminated on its outer surface.

For the bonding between the heat dissipating layer 1 and the elastic layer 2, and the bonding between the elastic layer 2 and the demolding layer 3, a primer layer (not shown) may be provided between respective layers.

In the sleeve 10, which is approximately cylindrical, the heat dissipating layer 1 is an inner face side, and the demolding layer 3 is an outer face side. As described above, the alternating magnetic flux acts on the heat dissipating layer 1, so that an eddy current is generated in the heat dissipating layer 1 and heat is generated in the heat dissipating layer 1. That heat heats the sleeve 10 through the elastic layer 2 and the demolding layer 3, and heats the recording material P which is fed to the fixing nip N, thereby performing the heating and fixing of the toner image.

a. Heat Dissipating Layer 1

For the heat dissipating layer 1, a metal of a strong magnetic material such as iron, strong magnetic SUS (Steel Use Stainless), and nickel cobalt alloy is preferably used.

Although a non-magnetic metal may be used, a metal such as nickel, iron, magnetic stainless and cobalt nickel alloy which are excellent in absorption of the magnetic flux is more preferable. It is preferable that the thickness thereof is made thicker than a superficial skin depth represented by the following expression, and moreover, is equal to or less than 200 μm. The superficial skin depth σ [mm] is represented by a frequency f [Hz] of the excitation circuit 27, a magnetic permeability μ, and an intrinsic resistance ρ [Qm] as follows:

$$\sigma=503\times(\rho/f\mu)^{1/2}$$

The thickness of the heat dissipating layer 1 is preferably 1 to 100 μm, and more preferably 20 μm to 100 μm. When the thickness of the heat dissipating layer 1 is smaller than 1 μm, since almost all the electromagnetic energy is not absorbed, the efficiency is deteriorated. Further, in view of the mechanical strength, the thickness of the heat dissipating layer 1 is desirable to be approximately equal to or more than 20 μm.

Further, when the heat dissipating layer 1 exceeds 100 μm, the rigidity thereof becomes too strong, and moreover, flexing properties are deteriorated, and using it as a rotation body is unrealistic. Consequently, it is desirable that the thickness of the heat dissipating layer 1 is decided in the range of preferably 1 μm to 100 μm, and more preferably 20 μm to 100 μm in consideration of the mechanical strength. In the present embodiment, a nickel electroforming plating product of a thickness of 50 μm has been used.

b. Elastic Layer 2

The elastic layer 2 is a material such as silicone rubber, fluorine rubber and fluorine silicone rubber, and is excellent in heat resistance and heat conductivity.

To prevent a fine mosaic defect on the image, which develops at the fixing time, this elastic layer plays an important role. That is, at the using time of a wax inclusive toner, unlike the using time of a sharp melt system toner, the effect of the demolding layer 3, which is a surface layer of the sleeve 10, enwrapping the toner itself by reflecting the softness of the elastic layer 2 is required to prevent the mosaic defect.

Hence, as the elastic layer 2, hardness as a rubber element is required to be 30 degree or less in hardness regulated by a JIS-A measurement, that is, by an A type hardness meter of JIS-K630, and more preferably 25 degree or less, and the thickness thereof preferably 50 μm or more, and more preferably 100 μm or more.

In the meantime, when the thickness of the elastic layer 2 exceeds more than 500 μm, the heat resistance of the elastic layer ends up becoming too large, and a quick start becomes difficult to be realized (almost impossible in the case of 1000 μm or more). Hence, the thickness of the elastic layer 2 is desirable to be 500 μm or less.

Further, the heat conductivity λ of the elastic layer 2 is $2.5\times10^{-1}$ to $8.4\times10^{-1}$ [W/m/° C.], and in case the heat conductivity λ is smaller than $2.5\times10^{-1}$ [W/m/° C.], the heat resistance is large, and the temperature rise in the surface layer (demolding layer 3) of the sleeve becomes slow.

In case the heat conductivity λ is larger than $4\times10^{-1}$ [W/m/° C.], the rigidity is prone to be high or a permanent compression set is deteriorated.

Hence, the heat conductivity λ is preferable to be $2.5\times10^{-1}$ to $8.4\times10^{-1}$ [W/m/° C.], and more preferably to be $3.3\times10^{-1}$ to $6.3\times10^{-1}$ [W/m/° C.] ($8\times10^{-4}$ to $1.5\times10^{-3}$ [cal/cm·sec·deg.]).

In the present embodiment, a silicone rubber having 10 degree (JIS-A) in rubber hardness as an element hardness, a heat conductivity of $4.2\times10^{-1}$ [W/m/° C.] ($1\times10^{-3}$ [cal/cm·sec·deg.]), and a thickness of 30 μm is used.

c. Demolding Layer (Releasing Layer) 3

The demolding layer 3 can select a material excellent in mold releasing properties and heat resistance such as fluorine resin, silicone resin, fluorine silicone rubber, fluorine rubber, silicone rubber, PFA, PTFE and FEP. The demolding layer 3 can be turned into such a tube layer of fluorine system resin or a resin coated layer.

To sufficiently impart the softness of the above described elastic layer 2 to the surface, the thickness of the demolding layer 3 is required to be preferably maximum 100 μm or less, or more preferably 80 μm or less. When it is thicker than 100 μm, the effect of enwrapping the toner is not displayed, and the mosaic defect develops on a solid image.

Further, as the elastic layer 2 becomes thinner, the upper limit value of the thickness of the demolding layer 3 is required to be made small. According to a result of study conducted by the present applicant, the thickness of the demolding layer 3 is required to be maximum one third the thickness of the elastic layer 2 or less, and when it is more than that thickness, the softness of the elastic layer 2 is not sufficiently reflected up to the surface layer.

In the meantime, when the thickness of the demolding layer 3 is below 5 μm, a mechanical stress applied to the elastic layer cannot be mitigated, and the elastic layer and the demolding layer themselves end up being deteriorated. Hence, the lower limit value of the thickness of the demolding layer 3 is required to be 5 μm or more, and more preferably 10 μm or more.

In the present embodiment, a PFA tube having a thickness of 30 μm is used as the demolding layer 3.

Summing up the relationship of the layer thickness between the elastic layer 2 and the demolding layer 3, when the thickness of the elastic layer 2 is taken as t1, and the thickness of the demolding layer 3 as t2, it is preferable that 50 μm≦t1≦500 μm, 5 μm≦t2≦100 μm, and t1≧3×t2.

d. Adiabatic Layer 4

Further, as shown in FIG. 5B, in the structure of the sleeve 10, the sleeve guide member face side (face side in opposition to the elastic layer 2 of the heat dissipating layer 1) may be provided with an adiabatic layer 4.

As the adiabatic layer 4, heat resisting resin such as fluorine resin, polyimide resin, polyamide resin, polyamide-imide resin, PEEK resin, PES resin, PPS resin, PFA resin, PTFE resin and PEP resin is preferable.

Further, as the thickness of the adiabatic layer 4, 10 to 1000 μm are preferable. In case the thickness of the adiabatic layer 4 is smaller than 10 μm, an adiabatic effect cannot be obtained, and moreover, durability also falls short. In the meantime, when the thickness exceeds 1000 μm, the distance from the magnetic cores 17*a*, 17*b* and 17*c* as well as the excitation coil 18 to the heat dissipating layer 1 becomes longer, and the magnetic flux cannot be sufficiently absorbed into the heat dissipating layer 1.

Since the adiabatic layer 4 can insulate the heat generated in the heat dissipating layer 1 in such a way as not to move to the inner side of the sleeve 10, comparing to the case where there is no adiabatic layer 4, the heat feeding efficiency to the recording material P side becomes good. Hence, the power consumption can be controlled.

D) Inner Peripheral Surface Regulating Member 201 (a and b)

Subsequently, the inner peripheral surface regulating member 201, which becomes a main component of the present invention, will be described.

As described above, the present inventors have found a new cause, which invites a metal fatigue of the flexible sleeve. This cause is such that, when the sleeve 10 is driven by the pressure roller 30, though the sleeve is deformed into a shape as natural as it desires, in case it is forced to be partially reformed into another shape, the stress partially acting on the sleeve becomes large, so that the fatigue phenomenon is accelerated. Hence, how the fatigue phenomenon due to this stress acting partially has been solved will be described below.

Figure 6:
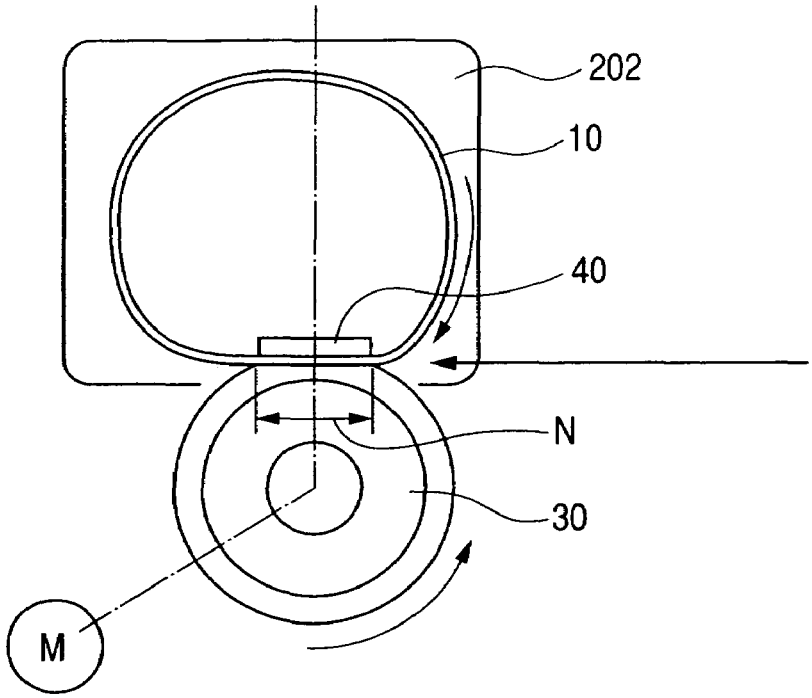
FIG. 6 is a view showing an outline of the end face of the sleeve in case the sleeve is rotated in a state in which an inner peripheral surface regulating member is removed.

First, the present inventors have found a shape of the sleeve 10 desired to be natural by driving (driving speed is the same as the fixing time period) the sleeve 10 in a state not attached with the inner peripheral surface regulating members 201*a* and 201*b* primarily attached to the fixing apparatus (the pressure applied between the good heat conductive member 40 and the pressure roller 30 is the same pressure at the fixing time period). At this time, since the sleeve 10 is rotated by the pressure roller in a state nipped by the pressure roller 30 and the good heat conductive member 40, the outline of its end face becomes an irregular shape as shown in FIG. 6.

Figure 7:
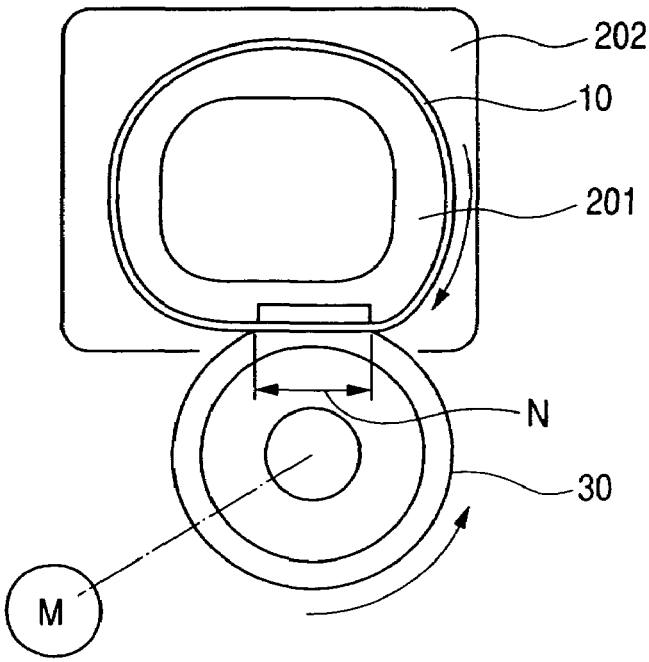
FIG. 7 is a simple sectional view of the image heating apparatus of the first embodiment attaching the inner peripheral surface regulating member having a outline similar to the outline of the sleeve of FIG. 6.

Based on this deformed state, the present inventors have disposed the inner peripheral surface regulating member 201, which is approximately similar to the outline of the end face in a rotation state of the sleeve 10 as shown in FIG. 7, and moreover, provides adequate intervals with the inner face of this sleeve 10, at the inner face side of both end portions in a generatrix direction of the sleeve 10. Consequently, the inner peripheral surface regulating member 201 has an opposing area opposed to the inner peripheral face of the end portion in a generatrix direction of the sleeve. That is, the shape (outline) of the outer peripheral face (opposing area) of the inner face regulating portion is set so as to be approximately similar to a shape generated when the sleeve 10 is rotationally driven at the time when there is no inner face regulating portion available. The opposing area of the inner peripheral surface regulating member of the present embodiment exists in the whole area in a peripheral direction of the sleeve inner face.

Figure 8:
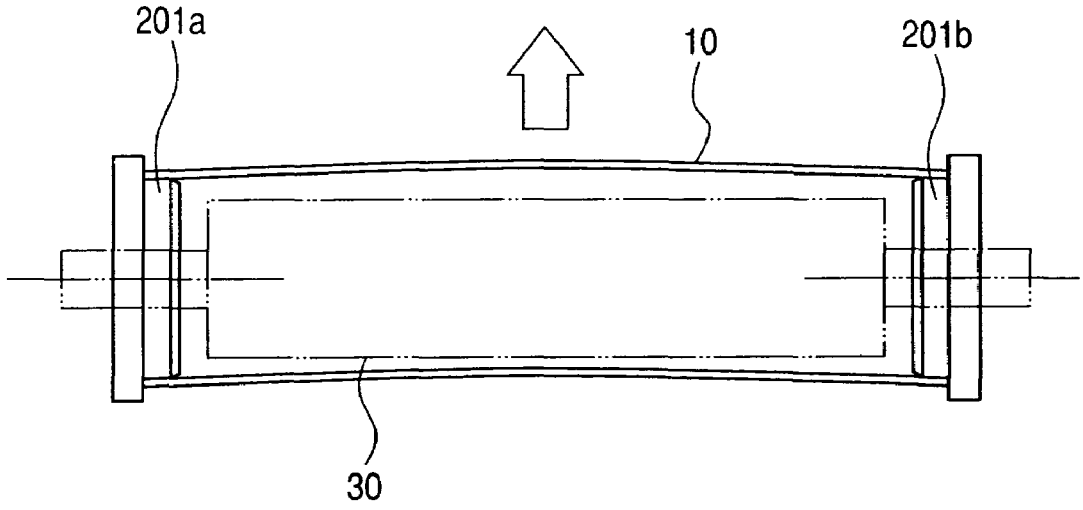
FIG. 8 is a view showing a deformation in a longitudinal direction of the sleeve in case of using a conventional inner peripheral surface regulating member.
Figure 15A:
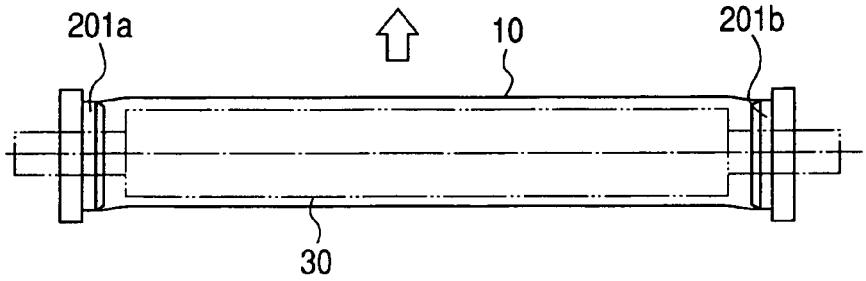
FIGS. 15A and 15B are views showing more in detail the deformation of the sleeve in a sleeve rotating state in case of using a conventional inner peripheral surface regulating member.
Figure 15B:
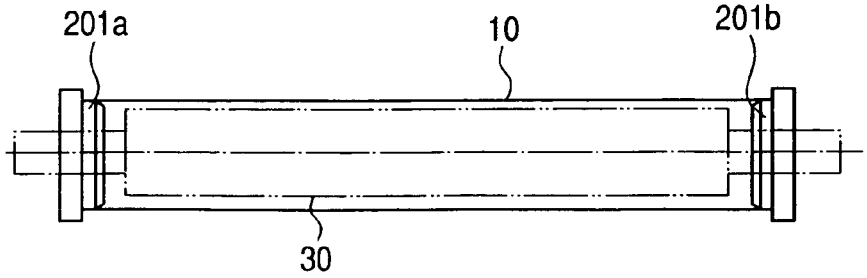

Due to such a outline setting of the opposing area of the inner peripheral surface regulating member, the stress acting on the sleeve can be controlled, and the durability of the sleeve is improved. The opposing area of the inner peripheral surface regulating member of the present embodiment, as described above, has an outline approximately similar to the outline of the sleeve end face when the sleeve being rotation, and moreover, has a outline shorter than the inner peripheral length of the sleeve, and therefore, hardly contacts the inner face of the sleeve during its rotation, but, in case the sleeve suddenly develops an irregular deformation, the opposing area has a function to regulate its deformation to the minimum by allowing the sleeve inner face to contact the opposing area of the inner peripheral surface regulating member. If the opposing area of the inner peripheral surface regulating member does not prevent the natural shape of the sleeve during its rotation, it may contact the sleeve inner face. Since a conventional inner peripheral surface regulating member does not take into consideration the natural shape primarily desired by the sleeve 10, the end portion of the sleeve 10 is deformed into an unnatural shape by the inner peripheral surface regulating member, while the central portion in a longitudinal direction of the sleeve attempts to become a primarily natural shape, thereby gaining the strength to curve the sleeve in a longitudinal direction. Such a state is shown in FIG. 8. The state more in detail is shown in FIGS. 15A and 15B. FIGS. 15A and 15B show a shape of the sleeve in case of using the conventional control member as the inner peripheral surface regulating member 201. FIG. 15A shows a shape of the sleeve 10 at its rotation driving time period, and FIG. 15B is a view showing the shape of the sleeve when the sleeve 10 stops its driving. Similarly to FIGS. 8, 15A and 15B, when the sleeve 10 receives a driving by the pressure roller 30, it attempts to deform in a direction of the arrow mark (recording material conveying direction). However, since the conventional inner peripheral surface regulating member is not similar to the outline (rotational locus) of the sleeve end face at the sleeve rotation time period, a distortion ends up developing between the two areas corresponding to the inner peripheral surface regulating members of both ends of the sleeve and the area between thereof (area of the nip portion) in the sleeve generatrix direction (longitudinal direction). This distortion, that is, the stress acting on the sleeve has been a cause to lower the durability of the sleeve.

In the meantime, by allowing the inner peripheral surface regulating member 201 to take the shape shown by the present invention, since there is no more need to forcibly change the primarily desired natural shape of the sleeve 10, a uniform natural deformation can be formed in the whole area in a longitudinal direction. That is, a local stress partially applied can be prevented.

Further, even if the end face of the sleeve 10 is caught on the surface of the sleeve end portion regulating member 202, and a force leading to a sudden abnormal deformation is applied, since the inner face of the sleeve 10 is reliably guided by the inner peripheral surface regulating member 201, the deformation can be prevented.

Figure 9:
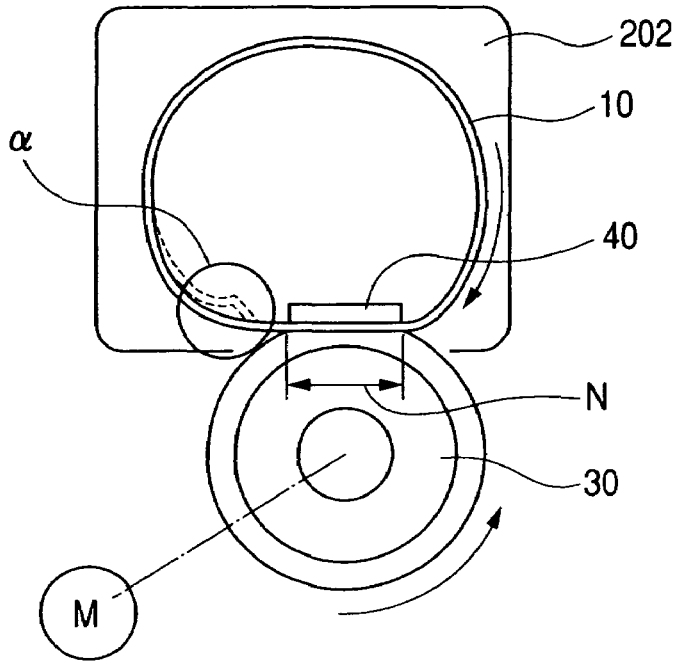
FIG. 9 is a view showing a sudden local deformation of the sleeve.

In case that an inner peripheral surface regulating member 201 does not exist, when the end face of the sleeve is caught on the end portion regulating member 202, the deformation of the sleeve as shown by α of FIG. 9 occurs, and this leads to the breakage of the sleeve 10 by the local stress. Consequently, though the inner peripheral surface regulating member of the present embodiment hardly contacts the inner face of the sleeve during the rotation of the sleeve, this is a component required to control a suddenly developed deformation of the sleeve to the minimum. If the above described inner peripheral surface regulating member of the present invention does not prevent a natural shape at the sleeve rotation time period (that is, if it is approximately similar to the outline of the sleeve end face during the sleeve rotates), it may contact the sleeve inner face.

In case the outline of the opposing area of the inner peripheral surface regulating member is allowed to be approximately similar to the outline of the sleeve end face at the sleeve rotation time period, and moreover, to be the same size as the sleeve inner face to be contacted, the sleeve 10 has a merit of securing an alignment to the axle center of the pressure roller by the inner peripheral surface regulating members 201 provided at both the end portions.

In the present embodiment, as a result of study conducted by the present inventors, a clearance gap between the sleeve 10 and the inner peripheral surface regulating member 201 is set so as to become 0.5 mm. In this way, an approaching force of the sleeve 10 has been remarkably reduced, and at the same time, a structure has been realized, in which the stress of the sleeve 10 locally does not rise, and in executing 500 thousands prints in a durability test, a problem-free result has been obtained.

In the study of the present inventors, in case the clearance gap between the sleeve 10 and the inner peripheral surface regulating member 201 is set to 1.5 mm or more, since the effect of guiding the end portion inner face of the sleeve 10 wears away when the sleeve 10 suddenly develops a deformation, it is preferable that the clearance gap is set to below 1.5 mm.

(Second Embodiment)

In the first embodiment, with respect to the sleeve 10 and the inner peripheral surface regulating member 201, the shape of the inner peripheral surface regulating member 201 for performing a suitable action at the endurance time period (sleeve rotation time period) has been described. Here, to make further upgrade, a shape design of the inner peripheral surface regulating member 201 will be described.

As described above, though the description was made that, in case the sleeve 10 is guided by the sleeve guide member 16, there are problems that the heat of the sleeve 10 is deprived by the contact of the sleeve guide member 16 so as to influence a fixing ability, even in the case of this inner peripheral surface regulating member 201, though it is the end portion of the sleeve 10, when it is made as large as the sleeve inner face to be contacted, it is believed to deprive the heat of the sleeve 10 to a certain degree.

Hence, to confine such an influence to the minimum possible, providing an adequate groove for the outer periphery of the inner peripheral surface regulating member 201 and reducing a contact area between the sleeve 10 and the inner peripheral surface regulating member 201 become effective means. In the present embodiment also, the outline of the opposing area of the inner peripheral surface regulating member is approximately similar to the outline of the sleeve end face during the sleeve rotation.

Figure 10A:
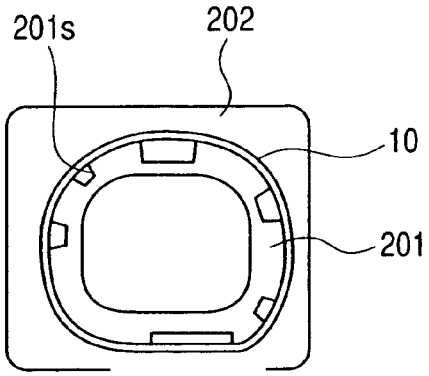
FIGS. 10A and 10B are views showing a shape of the inner peripheral surface regulating member which is mounted on the image heating apparatus of a second embodiment.
Figure 10B:
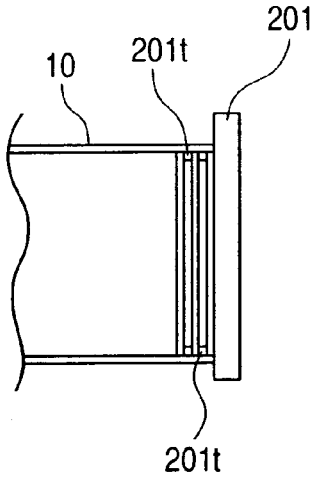

In FIGS. 10A and 10B are shown specific shape examples of the inner peripheral surface regulating member 201 in the present embodiment.

FIG. 10A is an example wherein a groove 201*s* is formed in a sectional direction (that is, the opposing area of the inner peripheral surface regulating member is divided into a plurality of portions by the grooves in a sleeve peripheral direction), and is an example wherein a function of position control and shape control of the sleeve 10 which is the purpose of the present embodiment is maintained, while reducing a contact area.

Further, in this case, since grease given as a lubricant between the sleeve 10 and the inner peripheral surface regulating member 201 can be held by the groove 201*s*, maintaining an effect of grease for a long period of time can be expected.

FIG. 10B is an example wherein a groove 201*t* is formed in a rotational direction (that is, the opposing area of the inner peripheral surface regulating member is formed with a groove along a peripheral direction of the sleeve), and is an example wherein a function of position control and shape control of the sleeve 10 which is the purpose of the present embodiment is maintained, while reducing a contact area.

Here, the shape of this groove 201*t* is made helical, and by the rotation of the sleeve 10, the grease given as a lubricant between the sleeve 10 and the inner peripheral surface regulating member 201 forms its helical direction in a direction to constantly return to the longitudinal inner side of the sleeve 10, and this results also in the effective means to maintain the effect of the grease.

(Third Embodiment)

In the first embodiment, with respect to the sleeve 10 and the inner peripheral surface regulating member 201, the structure for performing a suitable action at the endurance time has been described. Here, though the sleeve 10 can control the movement in a sectional direction (direction vertical to a longitudinal direction) by the inner peripheral surface regulating member 201, with respect to the position control in a longitudinal direction, the sleeve end portion regulating member 202, which is a fixed wall, slides with the sleeve 10, and the friction thereof has possibilities of causing a problem. Hence, to aim at further improvement of the durability, accompanied with the rotation of the sleeve 10, flanges 23*a* and 23*b* rotating together are provided at both end portions of the sleeve. In the present embodiment, this flange corresponds to the end portion regulating member. In the present embodiment also, the outline of the opposing area of the inner peripheral surface regulating member is approximately similar to the outline of the sleeve end face during the sleeve rotation.

Figure 11:
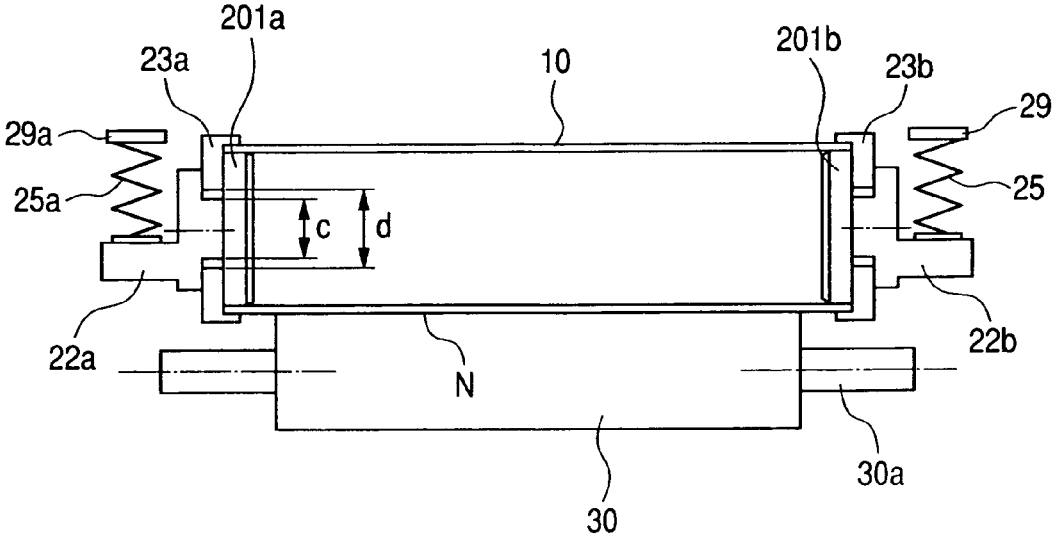
FIG. 11 is a front view of the image heating apparatus of a third embodiment.

As shown in FIG. 11, the flange 23*a* (as well as 23*b*) has a position in a longitudinal direction regulated by end portion holders 22*a* and 22*b*. That is, the flange 23*a* (as well as 23*b*) is constituted in such a way as to rotate and slide for the end portion holder 22*a* (as well as 22*b*). That is, the flanges 23*a* and 23*b* are ring members rotated when contacted by the end face of the sleeve 10. In this way, by constituting the flange 23*a* (as well as 23*b*) to rotate for the end portion holder 22*a* (as well as 22*b*), the friction caused by the sliding between the end face of the sleeve 10 and the flange can be prevented.

At this time, the position control of the sleeve is strictly performed by the inner peripheral surface regulating member 201, and to enable the flanges 23*a* and 23*b* to bear a function only to control the end portion of the sleeve in a longitudinal direction, adequate clearance gaps d−c are required between an inner diameter d of the flanges 23*a* and 23*b* and an outer diameter c of the end portion holders 22*a* and 22*b* in a fitting portion.

In the present embodiment, in FIG. 11, by assuming that d=33.0 mm, c=29.00 mm and a gap=1.0 mm, the upgrade aimed by the present embodiment has been accomplished.

As the material of the end portion holders 22*a* and 22*b*, similarly to the flanges 23*a* and 23*b*, heat resisting resin such as PPS, LCP and PI may be used, and in addition to this, an adequate metallic material (brass and the like) may be used.

(Fourth Embodiment)

Figure 12A:
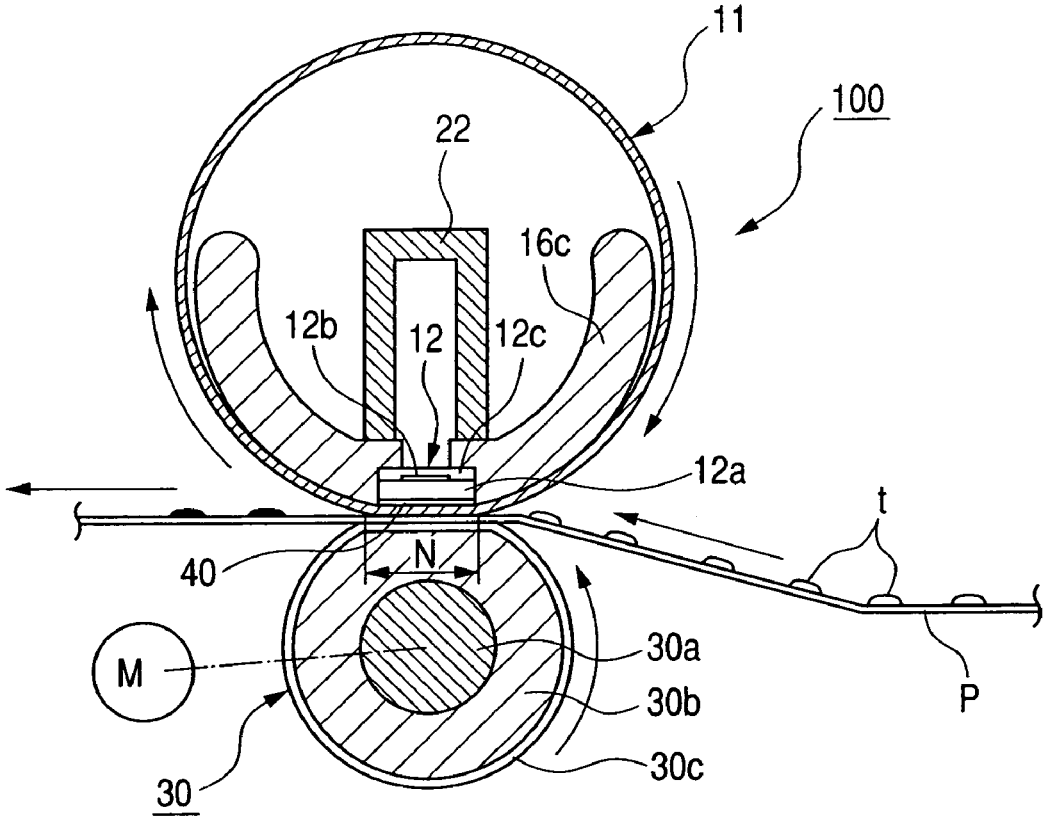
FIGS. 12A and 12B are sectional views of the image heating apparatus of a fourth embodiment.
Figure 12B:
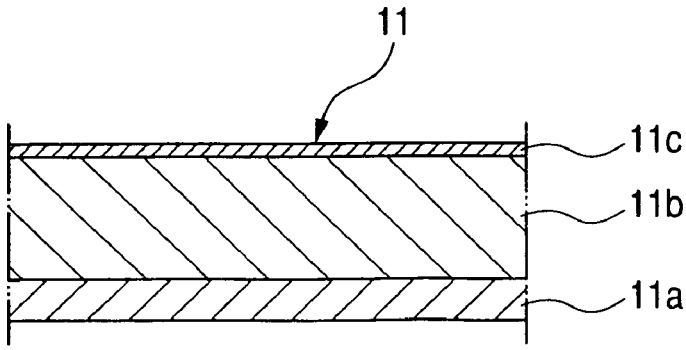

The fixing apparatus of the present embodiment becomes a heater 12 when a sliding member, which forms a nip portion together with a pressure roller, generates heat by power distribution. Consequently, in the present embodiment, a sleeve itself does not generate heat. FIGS. 12A and 12B are sectional model views of a fixing apparatus in the present embodiment. FIG. 12B particularly shows a section of the sleeve portion. In FIG. 12B, the upper side of the drawing is the outer face side, and the lower side of the drawing is the inner face side.

Reference numeral 16*c* denotes a heat resisting and heat insulating sleeve guide (film guide) of an approximately semi-circular arc tubbish type in section, and its function is approximately the same as the sleeve guide member 16 of the first embodiment, and it does not positively contact the sleeve inner face. Reference numeral 12 denotes a ceramic heater as a sliding member, and is intruded into a groove formed and provided along a guide length approximately at a center portion of the lower face of the sleeve guide 16*c*, and fixed and supported.

Reference numeral 11 is a flexible sleeve (fixing sleeve). This sleeve 11 is loosely engaged externally with the sleeve guide 16*c*.

The sleeve guide 16*c* has a pressure rigid stay 22 which is inserted into its inner side.

Reference numeral 30 is a pressure roller (sleeve driving roller) having an elastic layer, and an elastic layer 30*a* such as silicone rubber is provided for a core bar 30 to reduce its rigidity, and both end portions of the core bar 30*a* are disposed by rotatably bearing and holding them between chassis side plates of the near side and back side of the apparatus. To improve superficial properties, a fluorine resin layer 30*c* such as PTFE, PFA and FEP may be provided further on its outer periphery.

With respect to pressure means for forming a fixing nip N, the same structure as the first embodiment is adopted, and the description thereof will be omitted here. An inner peripheral surface regulating member, similarly to the first embodiment, is approximately similar to the outline of a sleeve end portion in a natural deformation state at the sleeve rotation time. However, in the case of the present embodiment, in the position corresponding to the nip portion in a sleeve peripheral direction, there exists no inner face opposing area of the inner peripheral surface regulating member.

A pressure roller 30 can use the same roller as that of the first embodiment. Here, the pressure roller 30 is rotated in a counter-clock direction shown by the arrow mark by driving means M. By the frictional force between the pressure roller 30 and the outer face of the sleeve 11 by the rotational driving of this pressure roller 30, a rotational force is acted on a sleeve 11, and the sleeve 11, while its inner face adheres to the lower face of the ceramic heater 12 at the fixing nip N and slides, is put into a state of rotating around the outer periphery of the sleeve guide member 16*c* with a peripheral velocity approximately corresponding to a rotation peripheral velocity of the pressure roller 30 in a clock wise direction shown by the arrow mark (pressure roller drive system).

To reduce a mutual sliding frictional force between the lower face of the ceramic heater 12 in the fixing nip portion N and the inner face of the sleeve 11, in the lower face of the ceramic heater 12 of the fixing nip portion N, a lubricating layer 40 is formed, and a lubricant such as a heat resisting grease is interposed between the lubricating layer 40 and the inner face of the sleeve 11.

The rotation of the pressure roller 30 is started based on a print start signal, and a heat up of the ceramic heater 12 is started. The rotational peripheral velocity of the sleeve 11 by the rotation of the pressure roller 30 becomes steady, and moreover, a recording material P borne with a toner image t advances between the sleeve 11 of the fixing nip portion N and the pressure roller 30 in a state in which the ceramic heater 12 has risen to a predetermined temperature. The recording material P adheres to the lower face of the ceramic heater 12 through the sleeve 11, while moving and passing through the fixing nip portion N together with the sleeve 11.

In the course of its moving and passing through the nip portion, the heat of the ceramic heater 12 is given to the recording material P through the sleeve 11 so that the toner image t is heat-fixed on the recording material P surface. The recording material P which has passed through the fixing nip portion N is separated from the surface of the sleeve 11 and conveyed.

The sleeve 11, as shown in FIG. 12B, comprises a base layer 11*a*, an elastic layer 11*b* and a releasing layer 11*c*. Here, the base layer 11*a*, to improve the durability, uses a SUS (Steel Use Stainless) metallic film having a thickness of 60 μm instead of a resin film such as PI often used conventionally.

Further, the elastic layer 11*b*, to improve a fixing ability at the color image fixing process, is provided in case of necessity, and in the fixing apparatus such as a black and white printer, it is not necessarily required. In the present embodiment, as the elastic layer 11*b*, a silicone rubber having a rubber hardness of 10 degree (JIS-A), a heat conductivity of $4.18605\times10^{-1}$ W/m·° C. ($1\times10^{-3}$ [cal/ cm·Sec·deg]), and a thickness of 200 μm is used, and as the releasing layer 11*c*, a PFA coat layer having a thickness of 20 μm is used. As the releasing layer 11*c*, the PFA tube similarly to the first embodiment may be used. The PFA coat can be made thin in thickness, and it has an excellent point in that the effect of enwrapping the toner is larger comparing to the PFA tube material-wise. In the meantime, as for the mechanical and electrical strength, the PFA tube is superior to the PFA coat, and therefore, they can be properly used according to the needs.

The ceramic heater 12 is a horizontal linear heating unit of a low heat capacity, which takes a direction orthogonal to the moving direction of the sleeve 11 as a longitudinal direction. Its basic structure consists of a heater substrate 12*a* composed of aluminum nitride and the like, an electrical resistance material such as the heat generating layer 12*b* (for example, Ag/Pd (silver/palladium)) provided along a longitudinal direction on the surface of this heater substrate 12*a* and coated and provided by a screen printing and the like with a thickness of approximate 10 μm and a width of approximate 1 to 5 mm, and a protective layer 12*c* such as glass and fluorine resin provided further on that material.

By supplying the electric power from both ends of the heat generating layer 12*b* of the ceramic heater 12, the heat generating layer 12*b* generates heat so that the heater 12 rapidly raises the temperature. The heater temperature is detected by an unillustrated temperature sensor, and the power supply to the heat generating layer 12*b* is controlled in an unillustrated control circuit so that the heater temperature is maintained at a predetermined temperature, thereby temperature-controlling the heater 12.

The ceramic heater 12 is fixed and supported by intruding the protective layer 12*c* side upward into a groove portion formed and provided along a longitudinal direction of the guide approximately at a center portion of the lower face of the sleeve guide 16*c*. The layer which contacts the inner face of the sleeve 11 is a sliding layer 40 of the surface on the opposite side to the protective layer 12*c*.

In the apparatus constituted as described above, the sleeve 11 and the pressure roller 30 are abutted against each other by a total pressure of 147.1 N (15 kg), so that a nip of approximate 8 mm is formed in a sleeve moving direction.

Even in the apparatus constituted as described above, the relationship between the sleeve 11 and the inner peripheral surface regulating member 201 is exactly the same as the case in the first embodiment. Here, when the inner peripheral surface regulating member 201 is disposed at both ends of the sleeve 11 under the similar condition shown in the first embodiment, in the print test for durability of approximate 300 thousands pieces, the breakage of the sleeve 11 does not occur and an excellent result is obtained.

(Fifth Embodiment)

Figure 13:
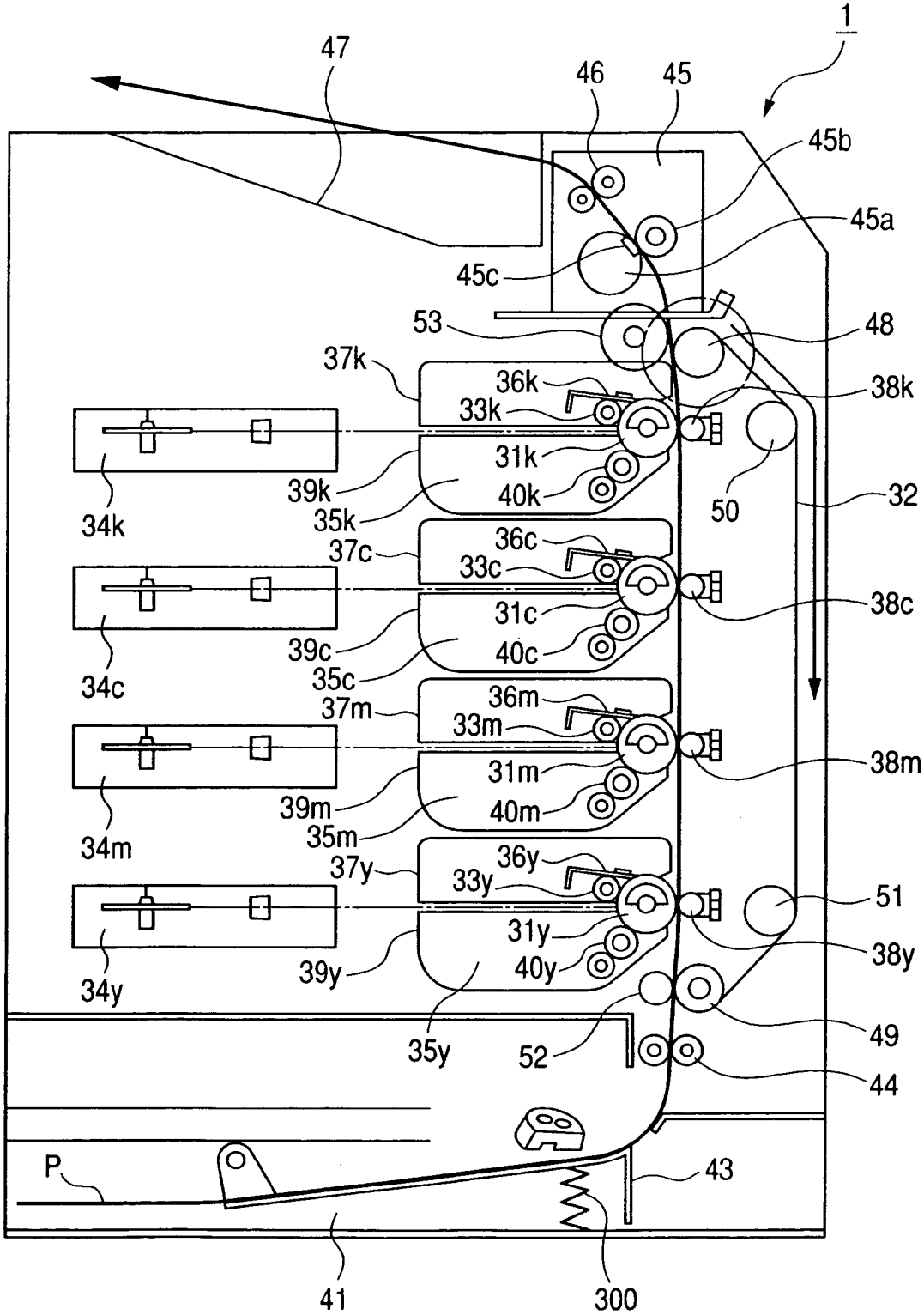
FIG. 13 is a sectional view of a color laser printer mounted with the image heating apparatus of the present invention.

Shown in FIG. 13 is a sectional view of an electrophotographic color laser printer mounting the image heating apparatus of the above described first to fourth embodiments as a fixing apparatus 45. The color image forming apparatus 1 shown in the drawing is linearly provided up and down with image forming units of four colors. Simply describing main components only, from below the drawing, a paper feeding cassette 41, an yellow image forming unit (y), a magenta image forming unit (m), a cyan image forming unit (c), a black image forming unit (k), a fixing device 45, a discharge tray 47 are disposed in that order. The conveying direction of the recording material is according to this order. Reference numeral 34 (y to k) denotes a laser scanner unit for scanning a photosensitive drum 31 (y to k) according to image information, and reference numeral 32 denotes a recording material conveying belt, and the constitution except for the fixing apparatus 45 is publicly known, and the description thereof will be omitted.

Figure 16:
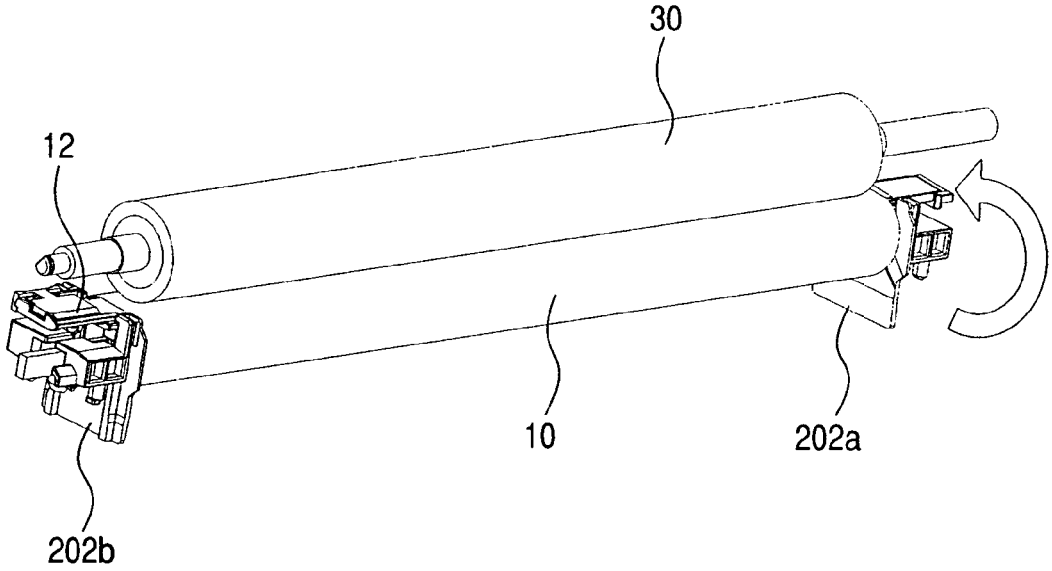
FIG. 16 is an oblique view of the fixing apparatus of a fifth embodiment (a frame which holds both ends of the axis of pressure roller 30 is omitted)
Figure 17:
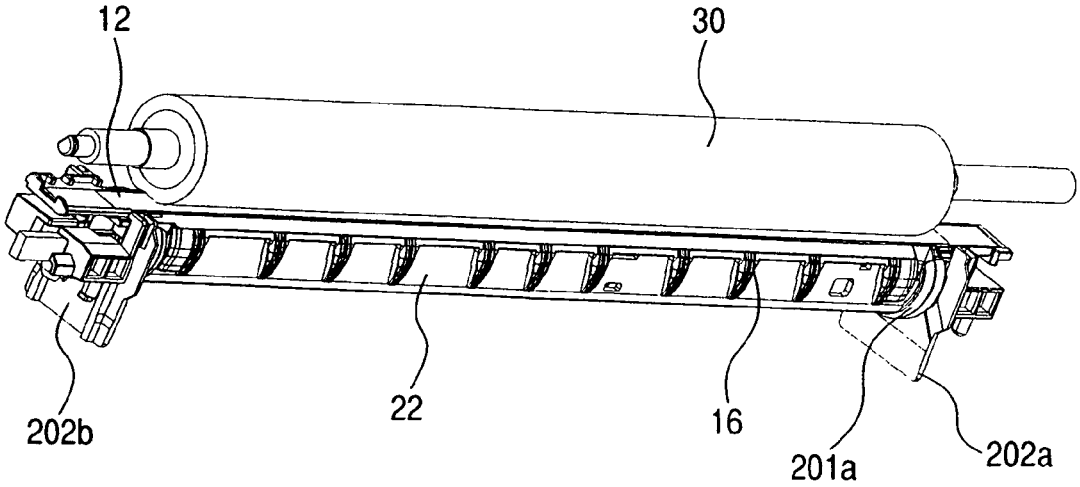
FIG. 17 is an oblique view showing a sleeve 10 further removed from the components described in FIG. 16, and a state in which a sleeve guide 16 and an inner peripheral surface regulating member 201 are exposed.
Figure 18:
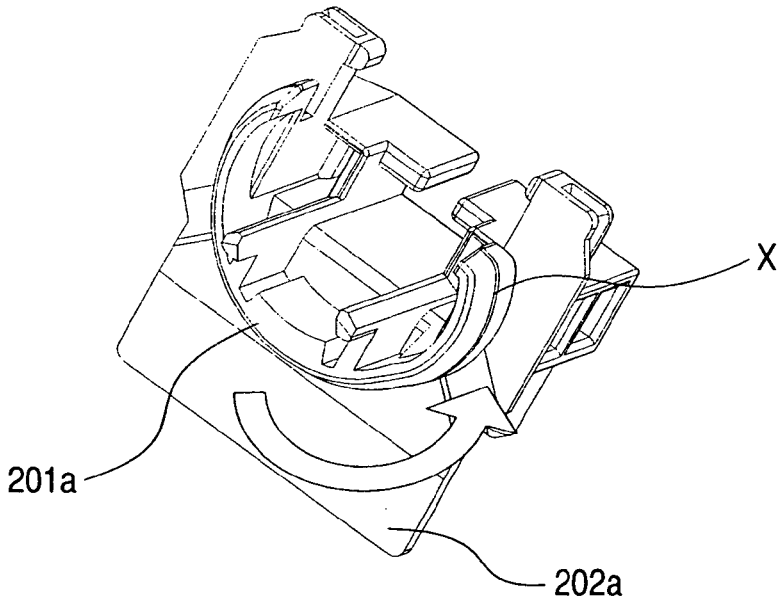
FIG. 18 is an oblique view of an inner peripheral surface regulating member 201*a* in a state attached to an end portion regulating member 202*a;*
Figure 19:
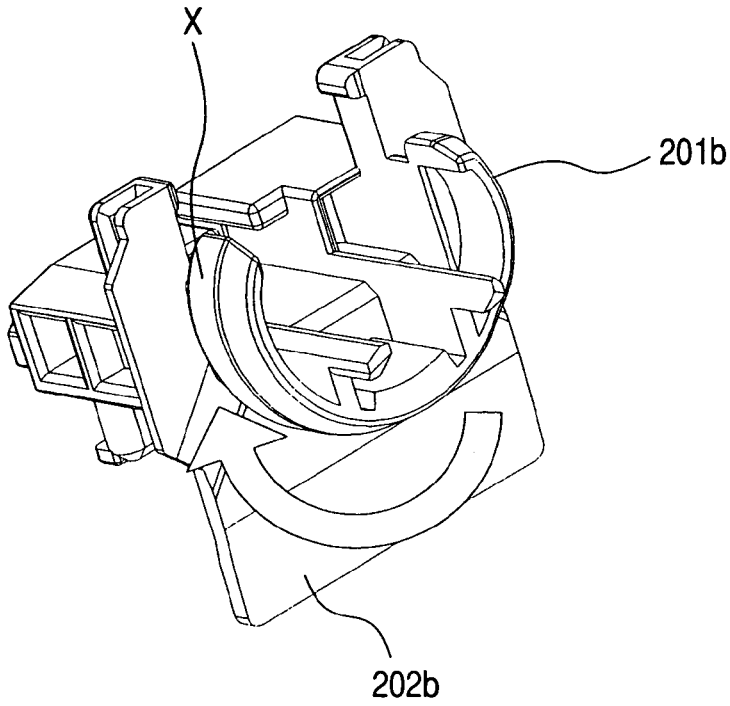
FIG. 19 is an oblique view of an inner peripheral surface regulating member 201*b* in a state attached to an end portion regulating member 202*b;*

Next, by using the fixing apparatus mounted on the laser printer shown in FIG. 13, a setting method of the outline of an opposing area of the inner peripheral surface regulating member opposed to the sleeve inner face used in the present invention will be described further in detail. FIG. 16 is an oblique view of the fixing apparatus of the present embodiment (a frame which holds both ends of the pressure roller 30 and the end portion regulating member 202 is omitted). In FIG. 16, the direction to an arrow mark is a rotational direction of the sleeve 10. FIG. 17 is an oblique view showing an exposed state of the sleeve guide 16 and the inner peripheral surface regulating member 201 with the sleeve 10 further removed from those described in FIG. 16. FIG. 18 is an oblique view of the inner peripheral surface regulating member 201*a* in a state of being attached to the end portion regulating member 202*a*, and FIG. 19 is an oblique view of the inner peripheral surface regulating member 201*b* in a state of being attached to the end portion regulating member 202*b*. In FIGS. 18 and 19, an X surface is an opposing area opposed to the inner face of the sleeve 10. In FIGS. 18 and 19, the direction to the arrow mark is a rotational direction of the sleeve 10. Although the fixing apparatus of the present embodiment is basically of the same constitution as shown in the fourth embodiment, the apparatus is shown as it is in the posture mounted in the printer shown in FIG. 13, and consequently, the sleeve 10 which contacts the toner image is shown in such a way as to be under the lower side of the pressure roller 30. Since the components of the present embodiment are basically the same as those of the fourth embodiment, reference numerals to be used are also the same.

Figure 20:
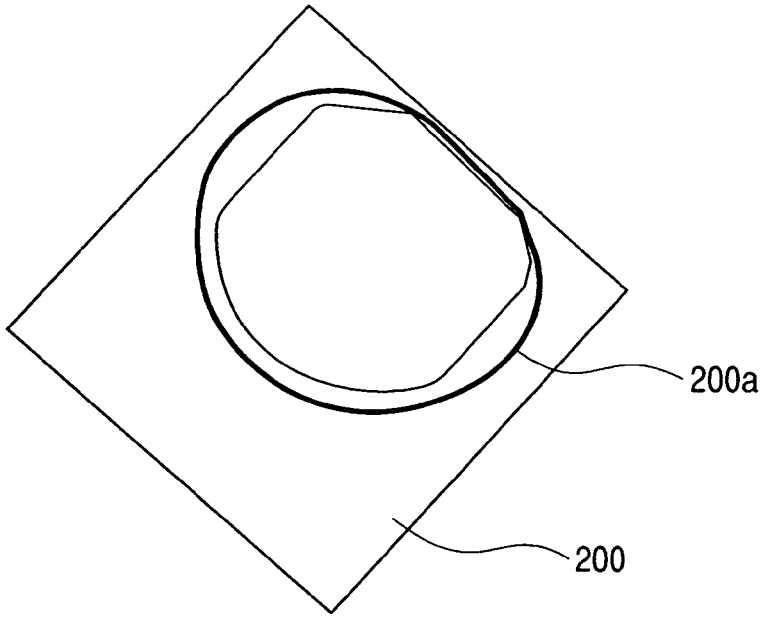
FIG. 20 is a view showing a planar measuring plate in a state in which a rotational locus of a sleeve end face is formed.

Although described in the first embodiment too, the present inventors have found a natural shape of the sleeve 10 during the rotation of the sleeve 10 by driving sleeve 10 in a state that the inner peripheral surface regulating member 201 removed from the fixing apparatus. To find the natural shape, first, the inner peripheral surface regulating member 201 is removed, and a planar measuring plate 200 instead of the inner peripheral surface regulating member 201 is attached to the inner side of the end portion regulating member 202 in a longitudinal direction of the heater. Then, the end face of the sleeve 10 is hit against the planar measuring plate 200 in a thrust direction (sleeve generatrix direction) so as to rotate it. Since the material of the planar measuring plate 200 is PPS (polyphenylene sulfide resin), when the sleeve end face is rotated in a state contacting the planar measuring plate 200, the rotational locus of the end face of the sleeve 10 is carved on the measuring plate 200 as a scar. In FIG. 20 is shown the planar measuring plate 200 in a state in which the rotational locus of the sleeve is formed. A hole opened in the measuring plate 200 shown in FIG. 20 is a hole through which the heater 12 and the end portion of the guide 16 are passed, and from among the outlines of the hole of FIG. 20, the flat portion above at the right side corresponds to the nip portion. The rotational locus carved on the measuring plate 200 is measured by a microscope with a coordinate measuring function (OLYMPUS MEASURING MICROSCOPE STM), and a coordinate of the rotational locus is plotted, thereby finding the rotational locus of the sleeve 10. From the rotational locus found in this way, a necessary area (that is, at least one part of the area removing the nip portion in a peripheral direction of the sleeve) is taken out as an opposing area X of the inner peripheral surface regulating member, so that the inner peripheral surface regulating member approximately similar to the rotational locus of the sleeve is prepared. The opposing area X of the inner peripheral surface regulating member may be a length of more than half the inner peripheral length of the end portion in the generatrix direction of the sleeve 10. Particularly, in the case of the fixing apparatus where the heater 12 is used similarly to the present embodiment, since the opposing area X of the inner peripheral surface regulating member is opposed to the inner peripheral face of the sleeve 10 in the area removing the nip portion in the peripheral direction of the sleeve 10, the length of the area removing this nip portion may be more than half the inner peripheral length of the sleeve.

Subsequently, the condition for attempting the optimization of the shape of this inner peripheral surface regulating member will be further described. As described above, the purpose of the present invention is to improve the durability of the sleeve. Consequently, the condition as to what shape the inner peripheral surface regulating member should take changes according to related parameters affecting a metal fatigue phenomenon particularly when the sleeve has a metallic layer. Taking into consideration this point, the parameters that become important, and the reason why those parameters are required will be described.

Figure 21:
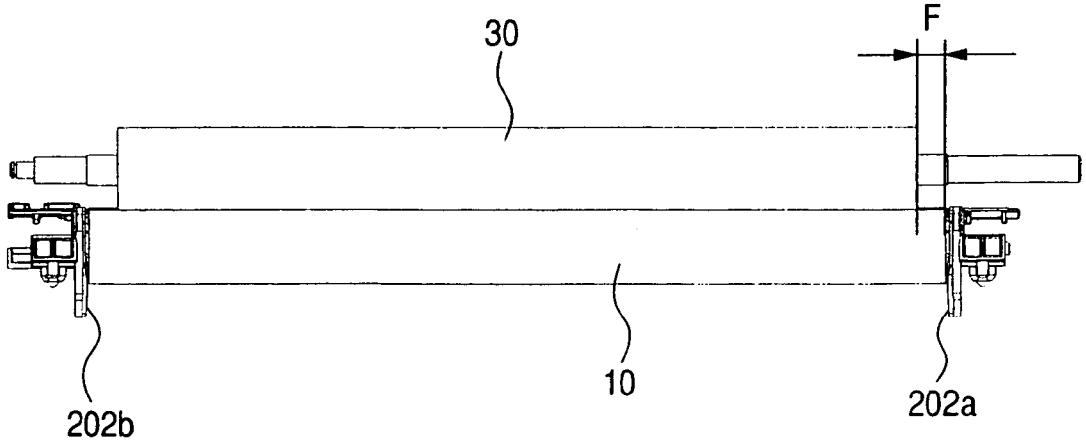
FIG. 21 is a view for illustrating a distance F between the sleeve end face and the end portion of the pressure roller.

Parameter 1: A Distance F from the End Portion of the Pressure Roller 30 to the End Portion of the Sleeve 10 (FIG. 21)

Reason: The sleeve 10 is deformed by being nipped and pressured by the pressure roller 30 and the heater 12 (by forming the nip portion N). Consequently, supposing that the inner peripheral surface regulating member is provided, which forcibly deforms the shape of the sleeve, when the distance F is short, a stress of the deformation by the nip portion N is applied on the deformed portion by the inner peripheral surface regulating member, and a metal fatigue of the sleeve is prone to occur. On the contrary, when the distance F is long, a stress of the deformation by the nip portion N is hard to be applied on the deformed portion by the inner peripheral surface regulating member, and the metal fatigue of the sleeve decrease. That is, the longer the distance F is, the harder the metal fatigue is to occur.

Parameter 2: An Allowable Stress δ of the Metallic Material of the Sleeve

Reason: The higher the allowable stress of the material is, the stronger the bearing force for the stress applied on the sleeve becomes.

Parameter 3: A Magnification P (FIGS. 24A to 24D) of the Inner Peripheral Surface Regulating Member for the Sleeve End Face Rotational Locus in a State in which the Inner Peripheral Surface Regulating Member is not Provided Reason: Even if the outline of the opposing area X of the inner peripheral surface regulating member is approximately similar to the outline at the sleeve rotation, the inner peripheral surface regulating member is too large, so that, when the sleeve is deformed by pushing it from the inner side, the metal fatigue is invited all the same. On the contrary, when the inner peripheral surface regulating member becomes too small so that a clearance gap with the sleeve becomes large, a function to regulate a sudden deformation of the sleeve (for example, in case the end portion of the sleeve 10 is caught on the surface of the sleeve end portion regulating member 202 due to a burr and the like, and is deformed) to the minimum possible is eliminated.

Parameter 4: A Shape Factor of the End Face of the Sleeve 10

Reason: it is generally known that the metal fatigue phenomenon rapidly becomes deteriorated when the opportunity is given. This opportunity often takes the form of a burr and a concavity of the end face of the sleeve or the irregularity of the surface. Although this is often referred to as a shape factor, to find this factor by a dynamical mathematical expression is difficult, and it is generally decided from the past record of experimental results.

Figure 22:
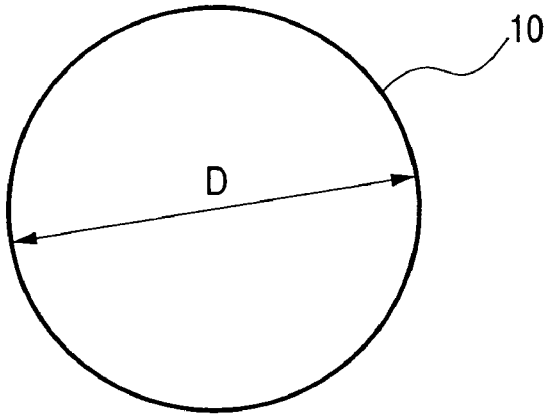
FIG. 22 is a view for illustrating an inner diameter D of the sleeve in a non-deformed state.
Figure 23:
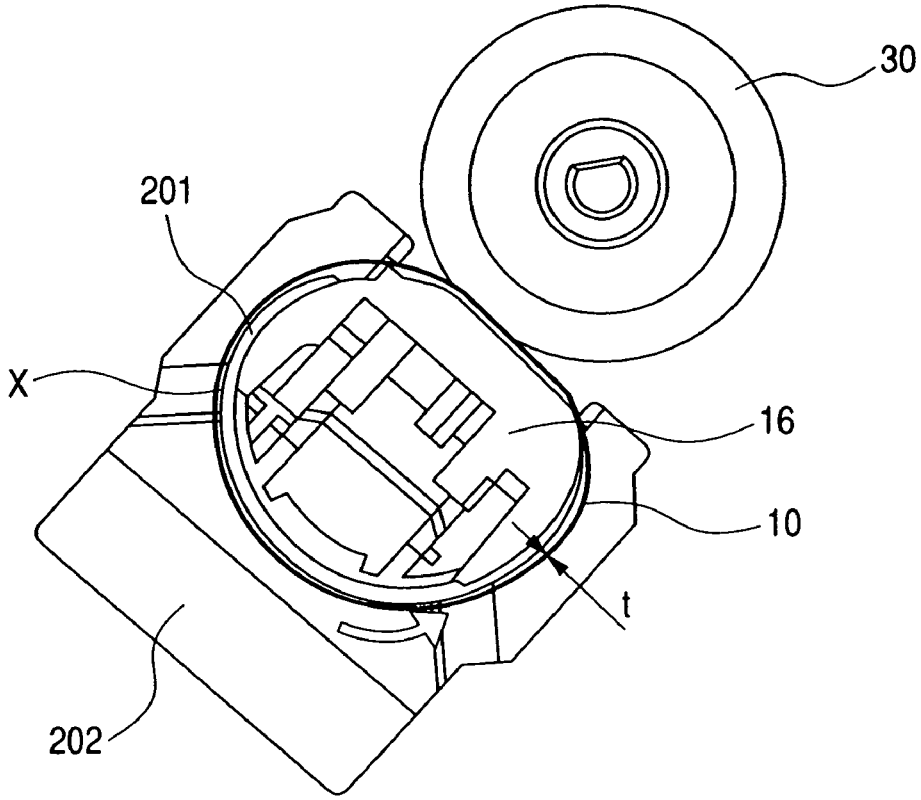
FIG. 23 is a sectional view of the fixing apparatus of a fifth embodiment.

The present inventor has expressed the above described related parameters 1 to 3 by the expression by the strength of the material, and introduced the following relational expression by adding it with the influence of the shape factor of the parameter 4 and a safety factor in the actual design by way of a total safety factor. Here, D and t are as shown in FIGS. 22 and 23. In FIG. 23, the arrow mark in a counter-clock wise direction is the rotational direction of the sleeve.

$$(P-1)\times(D/2)\times(t/0.03)\times(E/F)\times 0.0406<\delta$$

The above described expression calculates by using a common metallic flexible sleeve. A range of the thickness of the base material of the sleeve which establishes the above described expression is 0.01 mm≦t≦0.1 mm, and 0.03 of the term of t/0.03 is based on a thickness of 0.03 mm of the sleeve used at the experiment Provided that P: a magnification applied to the inner peripheral surface regulating member D: an inner diameter (mm) of the sleeve at the time of the non-deformed state (FIG. 22)

Figure 24A:
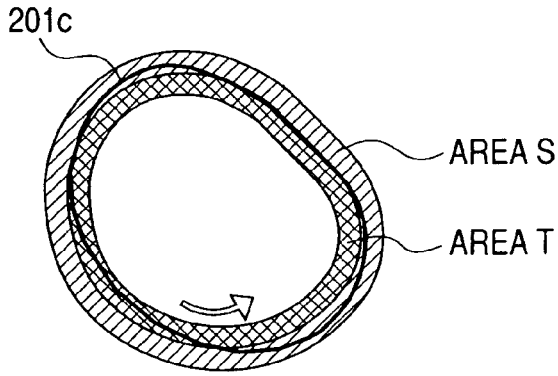
FIGS. 24A, 24B, 24C and 24D are views for explaining a outline similar to the rotational locus of the sleeve end face.

F: a distance (mm) between the one end portion of the sleeve and the end portion of the driving roller (pressure roller) on the same side t: a thickness (mm) of the base material (metallic layer) of the sleeve shown in FIG. 23 t/0.03: a thickness (though the unit of t is mm, since t/0.03 is a ratio, the unit of mm is not applied) of the metallic base of the sleeve E: Young's modulus (kg f/mm$^2$) of the metallic base material of the sleeve δ: an allowable stress (kg f/mm$^2$) of the metallic base material of the sleeve 0.0406: a factor defined from a total safety factor In the present embodiment, as the material of the sleeve, a SUS (Steel Use Stainless) 304 is used, and F=8 mm, D=24 mm and t=30 μm. The allowable stress δ in this case is 627 MPa (64 kgf/mm$^2$), and a modulus longitudinal elasticity is 20600. On assuming these numerical values, and based on the above described relational expression, an adequate magnification P as a outline of the inner peripheral surface regulating member is, as described above, in the range of ±1.051 times provided that the magnification of the shape α obtained from the planar measuring plate is taken as 1. However, the inner peripheral surface regulating member has to be a size to be contained in the sleeve. In the present embodiment, based on this assumption, a magnification of 1.025 is applied. That is, as shown in FIGS. 24A to 24D, a dimension of the outline of the inner peripheral surface regulating member is applied. As a result, the local stress of the sleeve can be controlled within a permissible limit, and the metal fatigue breakage of the sleeve comes to be prevented. The detailed description of FIGS. 24A to 24D will be made below. In FIG. 24A, the sleeve rotates in a direction of the arrow mark in a counter-clock wise direction.

In FIGS. 24A to 24D, when the sleeve 10 is driven in a state in which the inner peripheral surface regulating member 201 is not available, a range of a shape β ((P−1)·D/2, a range of magnification to the outside) which is larger to the outside than the shape α (in the drawing, a shape of the boundary between an area S and an area T) formed on the end portion of the sleeve 10 by the magnification P is shown as the area S, and a range of a shape γ ((P−1)·D/2, a range of magnification to the inner side) which is smaller than the shape α by the magnification P is shown as the area T. If an outline of the inner peripheral surface regulating member (in the drawing, a solid line 201*c*) is in the range of the area S and the area T, the above described expression will be satisfied, and since the deformation of the sleeve is within the allowable stress, the metal fatigue breakage of the sleeve can be prevented.

Figure 24B:
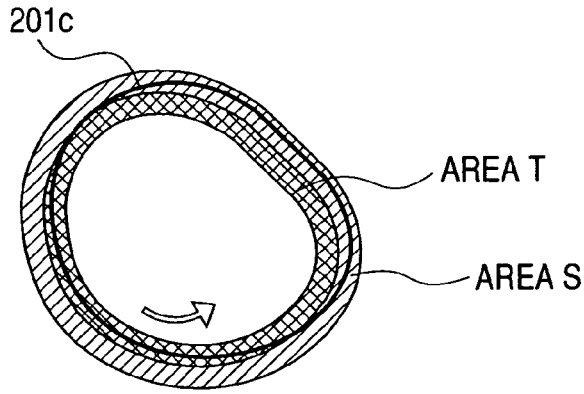
Figure 24C:
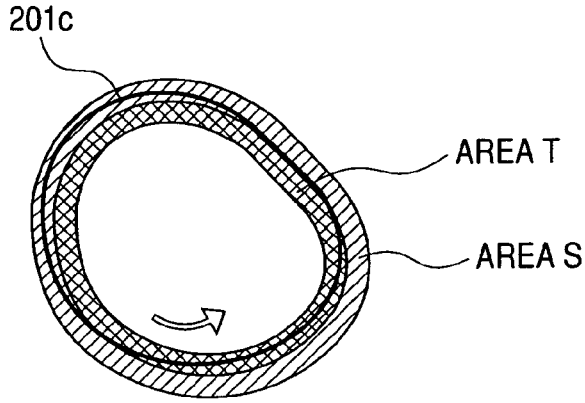
Figure 24D:
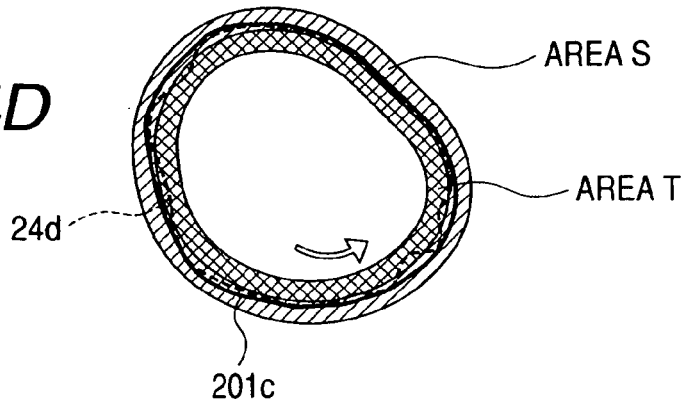

In FIG. 24A, the outline of the opposing area X of the inner peripheral surface regulating member 201 shown by the solid line 201*c* is formed obliquely below to the left in the shape γ in the drawing, and obliquely above to the left in the drawing, and obliquely below to the right in the shape β. Further, the outline of the opposing area X of the inner peripheral surface regulating member 201 is set shorter than the inner peripheral length of the sleeve. In the meantime, in FIG. 24B, though the outline of the opposing area X of the inner peripheral surface regulating member 201 shown by the solid line 201*c* has the same shape as the shape α, it shows a state in which the position of the inner peripheral surface regulating member 201 is moved in parallel upward to the right. In FIG. 24C, though the outline of the opposing area X of the inner peripheral surface regulating member 201 shown by the solid line 201*c* has the same shape as the shape α, it shows a state in which the position of the inner peripheral surface regulating member 201 is moved in parallel upward to the left. Any of the shapes of the inner peripheral surface regulating member 201 shown in FIGS. 24A, 24B and 24C is in the range of the above described expression, and can prevent the metal fatigue breakage of the sleeve. In any of the shapes shown in FIGS. 24A, 24B and 24C, through there exists a portion larger than the shape α (a part of the solid line 201*c* is contained in the area S), a swelling out for the shape α to such an extent does not create any problem, and it is within the similar shape for the shape α. As shown by the broken line 24*d* of FIG. 24D, even when the outline of the opposing area X of the inner peripheral surface regulating member 201 becomes convexo-concave, if the convex portion of this outline is fastened together, it becomes the solid line 201*c* of FIG. 24D. Since this outline 201*c* is contained in the area T and the area S, it has the same effect as FIGS. 24B and 24C.

The similar shape described in this way in the present invention is not limited to definitely the same shape as the shape of the sleeve end face when the sleeve is rotated by the driving roller in a state in which the inner peripheral surface regulating member 201 is removed, but includes those different in shape to a certain extent if within the magnification P (provided that the inner peripheral surface regulating member 201 has to be a size to be contained capable in the sleeve). Further, not only the unbroken shape shown in the solid line 201*c* from FIGS. 24A to 24D, but also the shape cut away in part as shown in FIGS. 18 and 19 are acceptable.

The present invention is not only applicable to an image heating apparatus using a metal based sleeve, but also applicable to an image heating apparatus using a sleeve, which is based on, for example, resin such as polyimide.

Further, it is only natural that the image heating apparatus of the present invention can be used not only as an image heating fixing apparatus, but also can be used in an image heating apparatus which heats a recording material bearing an image and improves superficial properties such as luster, and an image heating apparatus for performing a temporary fixing process.

The present invention is not intended to be limited to the above described embodiments, but includes modifications possible in the light of the above teachings.

This application claims priority from Japanese Patent Application Nos. 2004-024342 filed Jan. 30, 2004 and 2005-016607 filed Jan. 25, 2005, which are hereby incorporated by reference herein.

What is claimed is:

1. An image heating apparatus for heating an image formed on a recording material, comprising:

a flexible sleeve;

a driving roller which contacts an outer peripheral surface of said sleeve and rotates said sleeve;

a sliding member which contacts an inner peripheral surface of said sleeve and forms a nip portion together with said driving roller by nipping said sleeve between thereof; and an inner surface regulating member including an opposing area opposed to the inner peripheral surface of an end portion in a generatrix direction of said sleeve;

wherein the recording material is nipped and conveyed by the nip portion; and wherein an outline of the opposing area of said inner surface regulating member is approximately similar to an outline of an end face of said sleeve when said sleeve is rotated by said driving roller in a state in which said inner surface regulating member is not attached to said apparatus.

2. An image heating apparatus according to claim 1, wherein the outline of the end face of said sleeve when said sleeve is rotated by said driving roller, in a state in which said inner surface regulating member is not attached to said apparatus, is taken as α, and a shape which is larger than α by a magnification P as β, and a shape which is smaller than α by a magnification P as γ, the outline of the opposing area of said inner surface regulating member is contained in the areas of β and γ, and the magnification P is set in such a way as to satisfy the following relational expression:

$$(P-1)\times(D/2)\times(t/0.03)\times(E/F)\times 0.0406<\delta$$

wherein,

D is an inner diameter (mm) of the sleeve at the time of a non-deformed state,

F is a distance (mm) between the one end portion of the sleeve and the end portion of the driving roller on the same side, T is a thickness (mm) of the base material of the sleeve, E is Young's modulus (kg f/mm$^2$) of the base material of the sleeve, and δ is an allowable stress (kg f/mm$^2$) of the base material of the sleeve.

3. An image heating apparatus according to claim 1, wherein the opposing area of said inner surface regulating member opposes the inner peripheral surface of said sleeve in the area of more than half the inner peripheral length of the end portion in the generatrix direction of said sleeve.

4. An image heating apparatus according to claim 1, wherein the opposing area of said inner surface regulating member opposes the inner peripheral surface of said sleeve in the area excepting the nip portion in the peripheral direction of said sleeve.

5. An image heating apparatus according to claim 1, wherein the opposing area of said inner surface regulating member is divided into a plurality of portions in the peripheral direction of said sleeve.

6. An image heating apparatus according to claim 1, wherein the opposing area of said inner surface regulating member is provided with a groove along the peripheral direction of said sleeve.

7. An image heating apparatus according to claim 1, wherein said apparatus further comprising an end portion regulating member for regulating a movement of said sleeve in the generatrix direction, said end portion regulating member opposes the end face of said sleeve.

8. An image heating apparatus according to claim 7, wherein said inner surface regulating member and said end portion regulating member are integrally molded.

9. An image heating apparatus according to claim 7, wherein said end portion regulating member is rotatable by contact with the end face of said sleeve.

10. An image heating apparatus according to claim 1, wherein said apparatus further comprises an excitation coil for generating heat said sleeve by generating an eddy current in said sleeve.

11. An image heating apparatus according to claim 1, wherein said sliding member is a heater to generate heat by power supply.

12. an image heating apparatus according to claim 1, wherein said sleeve has a metallic layer.

13. An image heating apparatus for heating an image formed on a recording material, comprising:

a flexible sleeve;

a driving roller which contacts an outer peripheral surface of said sleeve and rotates said sleeve;

a sliding member which contacts an inner peripheral surface of said sleeve and forms a nip portion together with said driving roller by nipping said sleeve between thereof; and an inner surface regulating member including an opposing area opposed to the inner peripheral surface of an end portion in a generatrix direction of said sleeve;

wherein the recording material is nipped and conveyed by the nip portion; and wherein an outline of the opposing area of said inner surface regulating member is approximately similar to a rotational locus of said sleeve formed on a planar measuring plate when said sleeve is rotated by said driving roller in a state in which said inner surface regulating member is not attached to said apparatus, and moreover, an end face of said sleeve is contacted to the planar measuring plate.

14. An image heating apparatus according to claim 13, wherein the outline of the end face of said sleeve when said sleeve is rotated by said driving roller, in a state in which said inner surface regulating member is not attached to said apparatus, is taken as $\alpha$, and a shape which is larger than $\alpha$ by a magnification P as $\beta$, and a shape which is smaller than $\alpha$ by a magnification P as $\gamma$, the outline of the opposing area of said inner surface regulating member is contained in the areas of $\beta$ and $\gamma$, and the magnification P is set in such a way as to satisfy the following relational expression:

$$(P-1)\times(D/2)\times(t/0.03)\times(E/F)\times 0.0406<\delta$$

wherein,

D is an inner diameter (mm) of the sleeve at the time of a non-deformed state,

F is a distance (mm) between the one end portion of the sleeve and the end portion of the driving roller on the same side, T is a thickness (mm) of the base material of the sleeve, E is Young's modulus (kg f/mm$^2$) of the base material of the sleeve, and $\delta$ is an allowable stress (kg f/mm$^2$) of the base material of the sleeve.

15. An image heating apparatus according to claim 13, wherein the opposing area of said inner surface regulating member opposes the inner peripheral surface of said sleeve in the area of more than half the inner peripheral length of the end portion in the generatrix direction of said sleeve.

16. An image heating apparatus according to claim 13, wherein the opposing area of said inner surface regulating member opposes the inner peripheral surface of said sleeve in the area excepting the nip portion in the peripheral direction of said sleeve.

17. An image heating apparatus according to claim 13, wherein the opposing area of said inner surface regulating member is divided into a plurality of portions in the peripheral direction of said sleeve.

18. An image heating apparatus according to claim 13, wherein the opposing area of said inner surface regulating member is provided with a groove along the peripheral direction of said sleeve.

19. An image heating apparatus according to claim 13, wherein said apparatus further comprising an end portion regulating member for regulating a movement of said sleeve in the generatrix direction, said end portion regulating member opposes the end face of said sleeve.

20. An image heating apparatus according to claim 19, wherein said inner surface regulating member and said end portion regulating member are integrally molded.

21. An image heating apparatus according to claim 19, wherein said end portion regulating member is rotatable by contact with the end face of said sleeve.

22. An image heating apparatus according to claim 13, wherein said apparatus further comprises an excitation coil for generating heat said sleeve by generating an eddy current in said sleeve.

23. An image heating apparatus according to claim 13, wherein said sliding member is a heater to generate heat by power supply.

24. An image heating apparatus according to claim 13, wherein said sleeve has a metallic layer.

* * * * *

UNITED STATES PATENT AND TRADEMARK OFFICE

CERTIFICATE OF CORRECTION

PATENT NO. : 7,107,000 B2
APPLICATION NO. : 11/044534
DATED : September 12, 2006
INVENTOR(S) : Kenji Watanabe et al.

It is certified that error appears in the above-identified patent and that said Letters Patent is hereby corrected as shown below:

ON THE TITLE PAGE:
At Item (57), Abstract, Line 12, “a outlineoutline” should read --an outline--.

COLUMN 1:
Line 55, “above described” should read --above-described--.

COLUMN 2:
Line 34, “above described” should read --above-described--.
Line 66, “above described” should read --above-described--.

COLUMN 3:
Line 22, “further” should read --a further--.

COLUMN 4:
Line 45, “a” should read --an--.

COLUMN 5:
Line 21, “to” should be deleted.
Line 35, “forms” should read --form--.

COLUMN 6:
Line 63, “clock wise” should read --clockwise--.

COLUMN 7:
Line 5, “clock wise” should read --clockwise--.

COLUMN 8:
Line 64, “being” should read --becomes--.

COLUMN 11:
Line 8, “above described” should read --above-described--.

COLUMN 13:
Line 38, “above described” should read --above-described--.

COLUMN 16:
Line 27, “clock wise” should read --clockwise--.

COLUMN 17:
Line 56, “above described” should read --above-described--.

UNITED STATES PATENT AND TRADEMARK OFFICE

CERTIFICATE OF CORRECTION

PATENT NO. : 7,107,000 B2
APPLICATION NO. : 11/044534
DATED : September 12, 2006
INVENTOR(S) : Kenji Watanabe et al.

It is certified that error appears in the above-identified patent and that said Letters Patent is hereby corrected as shown below:

COLUMN 20:
Line 9, “above described” should read --above-described--.
Line 16, “clock wise” should read --clockwise--.
Line 19, “above described” should read --above-described--.
Line 21, “above” should read --above- --.
Line 24, “experiment” should read --experiment,--.
Line 25, “Provided” should read --provided--.
Line 42, “factor” should read --factor.--.
Line 49, “above described” should read --above-described--.
Line 64, “counter-clock wise” should read --counter-clockwise--.

COLUMN 21:
Line 11, “above described” should read --above-described--.
Line 35, “above described” should read --above-described--.
Line 38, “through” should read --though--.

COLUMN 22:
Line 6, “above described” should read --above-described--.

COLUMN 23:
Line 10, “comprising” should read --comprises--.
Line 27, “an” should read --An--.

COLUMN 24:
Line 36, “comprising” should read --comprises--.

Signed and Sealed this

Twenty-fourth Day of July, 2007

JON W. DUDAS
*Director of the United States Patent and Trademark Office*